United States Patent [19]

Bardenhagen et al.

[11] 4,004,395

[45] Jan. 25, 1977

[54] METHOD AND MACHINE FOR THE PRODUCTION OF HINGED-LID PACKS FOR GROUPS OF CIGARETTES OR THE LIKE

[75] Inventors: Dietrich Bardenhagen, Hamburg; Bernhard Schubert, Neubornsen, both of Germany

[73] Assignee: Hauni-Werke Korber & Co., KG, Hamburg, Germany

[22] Filed: Mar. 28, 1974

[21] Appl. No.: 455,926

Related U.S. Application Data

[62] Division of Ser. No. 331,028, Feb. 9, 1973, Pat. No. 3,802,325.

[30] Foreign Application Priority Data

Feb. 11, 1972 United Kingdom ..... 06569/72
Feb. 24, 1972 United Kingdom ..... 08674/72

[52] U.S. Cl. ..... 53/3; 53/389; 93/19

[51] Int. Cl.[2] ..... B65B 41/16

[58] Field of Search ..... 93/19, 20, 1 TS, 33 R, 93/63 R, 63 M; 83/408, 86; 270/58, 59; 53/389; 229/44 CB; 226/109, 179; 198/32, 211; 156/259, 264

[56] References Cited

UNITED STATES PATENTS

| | | | |
|---|---|---|---|
| 889,746 | 6/1908 | Bechman | 226/109 |
| 2,668,769 | 2/1954 | Schlienz | 93/63 M X |
| 2,929,180 | 3/1960 | Abrams et al. | 53/29 |
| 3,081,658 | 3/1963 | Witschi | 83/408 X |
| 3,107,589 | 10/1963 | Goettsh et al. | 226/109 X |
| 3,178,170 | 4/1965 | Walck | 270/58 |
| 3,312,133 | 4/1967 | Judelson | 83/408 X |
| 3,479,024 | 11/1969 | Miller | 270/58 |
| 3,566,752 | 3/1971 | Dreher | 93/1 TS |
| 3,677,144 | 7/1972 | Hudson | 93/20 X |
| 3,756,899 | 9/1973 | Von Hofe | 83/408 X |
| 3,805,477 | 3/1972 | Kruse | 53/236 X |
| 3,809,593 | 5/1974 | Burke et al. | 156/259 X |
| 3,811,768 | 5/1974 | Zahn | 83/408 X |
| 3,818,790 | 6/1974 | Culp | 83/408 |

*Primary Examiner*—Travis S. McGehee
*Assistant Examiner*—J. Sipos
*Attorney, Agent, or Firm*—Peter K. Kontler; John Kurucz

[57] ABSTRACT

Blanks for the making of inner envelopes of hinged-lid cigarette packs are obtained by withdrawing from a bobbin a web of metallic foil or thin paper which is coated with metallic foil, severing the web lengthwise to form two strips of unequal width, severing the strips crosswise to form two rows of rectangular sections, and moving each section of one row sideways toward the adjacent section of the other row so that the two sections partially overlap each other and form a composite blank which is transported sideways to be draped around a mandrel on a turret-shaped assembly conveyor.

13 Claims, 28 Drawing Figures

Fig.1
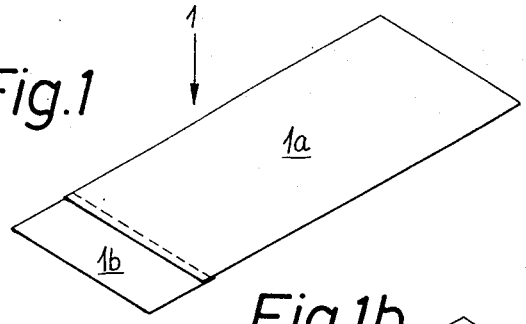
Fig.1a
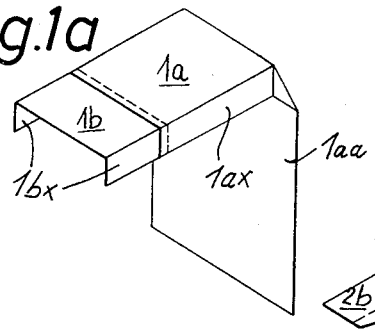
Fig.1b
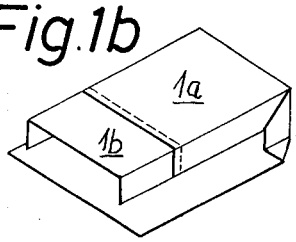
Fig.2
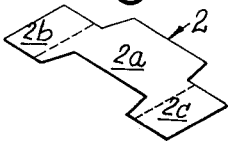
Fig.2a
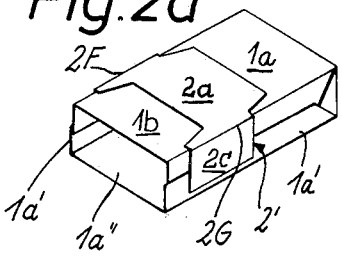
Fig.3
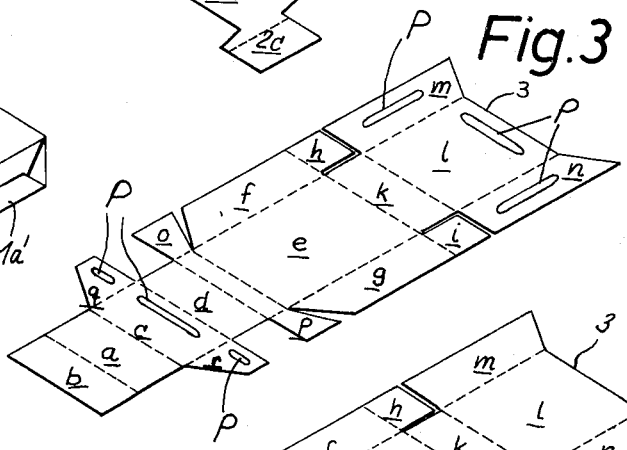
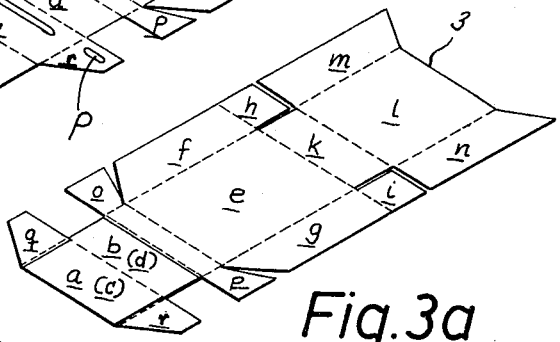
Fig.3a
Fig.3b
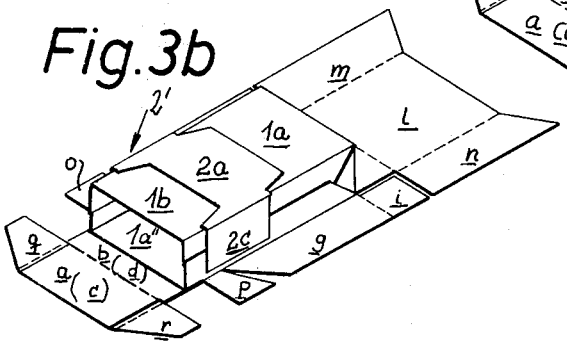

METHOD AND MACHINE FOR THE PRODUCTION OF HINGED-LID PACKS FOR GROUPS OF CIGARETTES OR THE LIKE

CROSS-REFERENCE TO RELATED APPLICATION

This is a division of the commonly owned copending application Ser. No. 331,028 filed Feb. 9, 1973, now U.S. Pat. No. 3,802,325 granted Apr. 9, 1974.

BACKGROUND OF THE INVENTION

The present invention relates to improvements in a method and machine for the production of so-called hinged-lid or flip-top packs for groups or blocks of plain or filter-tipped cigarettes, cigars, cigarillos or analogous rod-shaped articles. More particularly, the invention relates to improvements in a method and machine for the making of hinged-lid or flip-top packs of the type wherein an outer envelope consisting of relatively stiff material and embodying a pivotable lid surrounds at least one inner envelope which consists of relatively soft and readily foldable material, and wherein the pack further includes an insert of the type known as collar and serving to yieldably retain the pivotable lid in closed position as well as to guide the lid during movement between open and closed positions. The insert is normally secured to the internal surface of the outer envelope and is provided with at least two edge portions which guide and/or retain the pivotable lid.

A presently known machine for the making of hinged-lid packs for groups or blocks of cigarettes or analogous rod-shaped articles includes devices for surrounding a group of rod-shaped articles with a preferably two-piece inner envelope consisting exclusively of metallic foil or of soft paper which is lined with metallic foil. One section of the inner envelope is removed by the purchaser upon opening of the pack (i.e., upon completed pivoting of the hinged lid to its open position) to thus afford access to the adjacent ends of articles. In the next step, the collar is placed around the inner envelope so that it partially surrounds three sides of the inner envelope. This collar normally consists of relatively stiff paper or cardboard and its central panel is placed over the overlapping portions of the two sections which form the inner envelope. The blank which is to form the relatively stiff outer envelope is first converted into a substantially U-shaped body during transport on a chain conveyor and the group of articles (with the inner envelope and collar therearound) is thereupon placed into the U-shaped body. The chain conveyor continues to transport the U-shaped body past a series of folding members serving to convert the body into a tube which is closed at one end and is provided with a hinged lid at the other end.

A drawback of the just described packing machines is that their output is very low, normally only half the output of a modern high-speed machine for the production of plain or filter tipped cigarettes. Therefore, such packing machines cannot be directly coupled to machines for the mass-production of tobacco-containing rod-shaped articles because each producing machine turns out a number of articles which suffices for the processing in several packing machines.

It is further known to produce hinged-lid packs on a rotary turret. Each group of rod-shaped articles is first completely surrounded by an inner envelope of relatively soft material. The blanks which are to be converted into outer envelopes of the packs are treated on two successive conveyors the first of which cooperates with means for folding selected lateral flaps of the blanks and the second of which cooperates with means for folding certain additional flaps so that each blank resembles a U-shaped body which receives the inner envelope with a group of rod-shaped articles therein. The final steps of conversion of blanks into outer envelopes are carried out while the blanks move with a further turret. Thus, the final folding steps are performed while the blank for the outer envelope already contains a group of rod-shaped articles so that the articles of such group are likely to be deformed even if the blanks for the outer envelopes are provided with weakened (grooved or perforated) portions to facilitate folding during conversion into outer envelopes.

It is also known to produce so-called soft cigarette packs by draping blanks of relatively soft and pliable material around hollow mandrels which receive groups of rod-shaped articles. However, such procedure was never employed for the making of hinged-lid packs wherein at least one component consists of relatively stiff sheet-like material, such as a cardboard with a weight in excess of 150 grams per square meter. As a rule, a soft pack comprises an inner envelope of thin metallic foil and an outer envelope of soft paper.

A drawback of all presently known machines for the making of hinged-lid packs is that they produce an excessive number of rejects. Thus, if a conventional machine fails to deliver a single component of a hinged-lid pack or a single group or block of rod-shaped articles, the corresponding pack must be discarded which entails substantial losses in tobacco and/or in material of the packs. Moreover, the operation of the machine must be interrupted at frequent intervals, either due to malfunctions which are caused by defective packs or in order to remove one or more defective packs or portions of packs. As a rule, the defective packs or portions thereof must be removed by hand.

SUMMARY OF THE INVENTION

An object of the invention is to provide a novel and improved method of making and manipulating blanks which are to be converted into envelopes of cigarette packs, especially into inner envelopes of hinged-lid packs.

An additional object of the invention is to provide an apparatus or feeding unit which can automatically convert a web of metallic foil or the like into a succession of composite (multi-section) blanks which are suitable for the making of inner envelopes of hinged-lid packs for cigarettes or the like.

A feature of the invention resides in the provision of a method of producing and manipulating blanks for the making of packs for cigarettes or the like, particularly for the making of blanks which are to be converted into inner envelopes of cigarette packs. The method comprises the steps of withdrawing a web of flexible wrapping material from a bobbin or another suitable source and moving the web lengthwise, preferably in stepwise fashion, subdividing the web into composite rectangular blanks each of which consists of two sections, and transporting the blanks sideways to a transfer station.

The subdividing step may comprise severing the web lengthwise to form two elongated strips and severing the strips crosswise so that each strip yields a row or succession of rectangular sections. Each composite blank includes a section of one of the strips and a section of the other strip. The sections of each composite blank are preferably aligned with each other, as considered at right angles to the direction of transport of composite blanks to the transfer station.

The method preferably further comprises the step of moving one section of each composite blank toward the other section so that one section of each composite blank partially overlaps the other section. This overlapping step preferably takes place in the course of the aforementioned transporting step. As mentioned above, the transporting and/or moving step is preferably carried out in a plurality of stages (stepwise) which alternate with intervals of idleness.

More specifically, the transporting step may comprise moving one section of each composite blank toward the transfer station at a speed exceeding the speed of the other section of the respective composite blank so that the sections are staggered with respect to each other, as considered in the direction of transport toward the transfer station, thereupon moving the other section at a speed exceeding the speed of the one section so as to move the sections into substantial or accurate alignment with each other, and simultaneously moving one of the sections toward the other section so that one of the two sections partially overlaps the other section before the respective composite blank reaches the transfer station.

One section of each composite blank is preferably larger than the other section. The web may consist of relatively thin and readily foldable material, such as metallic foil or thin paper which is coated with metallic foil.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a perspective view of a blank which is to be converted into the inner envelope of a hinged-lid pack;

FIGS. 1*a* and 1*b* illustrate two successive stages of conversion of the blank shown in FIG. 1 into an inner envelope;

FIG. 2 is a perspective view of a second blank which is to be converted into the collar or insert of a hinged-lid pack;

FIG. 2*a* illustrates a partially completed inner envelope and a collar or insert which is obtained on conversion of the blank shown in FIG. 2;

FIG. 3 is a perspective view of a third blank which is to be converted into the outer envelope of a hinged-lid pack;

FIGS. 3*a* to 3*k* illustrate various stages of conversion of the blank shown in FIG. 3 into the outer envelope of a hinged-lid pack;

DESCRIPTION OF THE PREFERRED EMBODIMENTS

FIG. 1 illustrates a composite foil blank 1 which comprises partially overlapping rectangular sections 1*a* and 1*b*. Each of these sections is assumed to include a sheet of readily foldable paper coated with a layer of aluminum foil. The entire blank 1 is relatively thin and readily foldable.

Figure 3C:
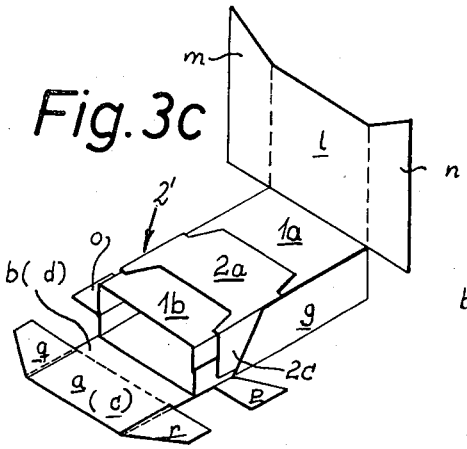
Figure 3D:
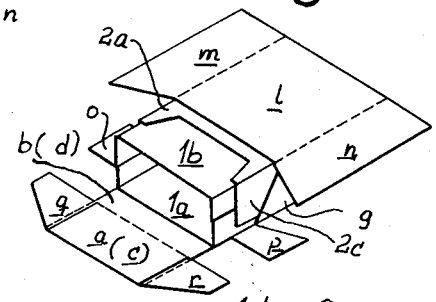
Figure 3E:
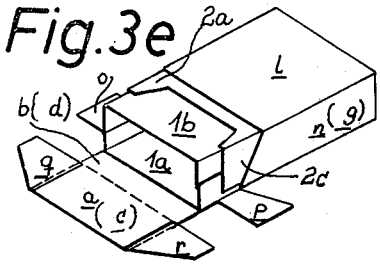
Figure 3F:
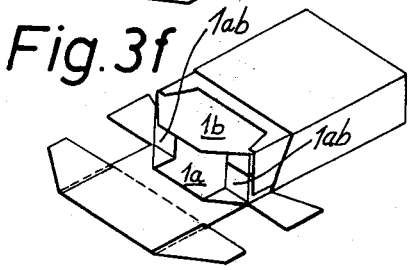
Figure 3G:
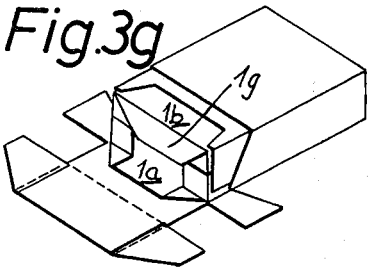
Figure 3H:
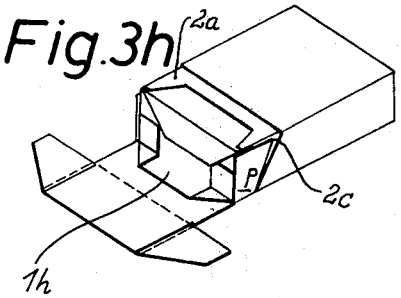
Figure 3I:
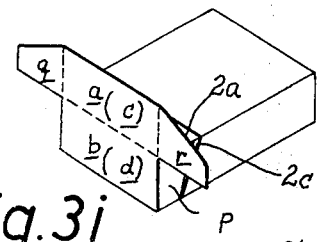
Figure 3K:
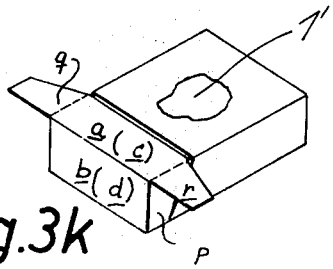
Figure 3L:
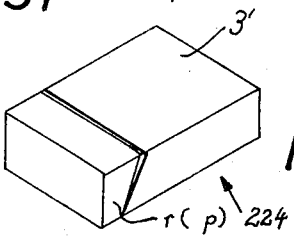
FIG. 3*l* is a perspective view of a hinged-lid pack which embodies the blanks of FIGS. 1, 2 and 3 and whose lid is shown in nearly fully closed position.

FIG. 2 illustrates a second blank 2 which consists of relatively stiff material, such as hard paper or cardboard, and is to be converted into a collar or insert 2' (see FIG. 2*a*) received in and secured to the outer envelope of a so-called hinged-lid pack or flip-top pack 224 shown in FIG. 3*l*. The blank 2 comprises three integral fields or panels 2*a*, 2*b* and 2*c*. The panels 2*b* and 2*c* are partially separated from the centrally located panel 2*a* by rows of perforations or by grooves so as to weaken the respective portions of the blank 2 and to allow for convenient folding during conversion into a substantially U-shaped collar or insert 2' shown in FIGS. 2*a*, 3*b* and 3*c*. In a fully assembled hinged-lid pack 224, the collar 2' serves to yieldably hold the pivotable lid of the pack in closed position and to guide the lid during pivoting between open and closed positions. Such functions are performed by the edge portions 2F, 2G (see FIG. 2*a*) of the collar 2' which coincide with the weakened portions of the blank 2. In a fully assembled pack 224, the insert or collar 2' which is obtained in response to conversion of a blank 2 partially surrounds three sides of a block 4 (see FIGS. 4*a* and 4*b*) of 20 filter cigarettes 4*a*.

FIG. 3 illustrates a prefabricated cardboard blank 3 which can be converted into the outer envelope 3' (see FIG. 3*l*) of a hinged-lid pack 224. This blank comprises a number of panels or fields *a,b,c,d,e,f,g,h,i,k,l,m,n,o,p,q* and *r*. The material of the blank 3 is a heavy or stiff paper or a lightweight cardboard. When converted into an outer envelope 3', the blank 3 not only constitutes an enclosure for a block 4 of twenty filter cigarettes 4*a* but also includes an integral flip-top or lid which must be pivoted to open position by the purchaser prior to withdrawal of a cigarette and can be returned to a closed position in which it cooperates with the edge portions 2F, 2G of the collar 2' (obtained upon suitable deformation of the blank 2 shown in FIG. 2) to remain in closed position. The blank 3 includes weakened portions (indicated in FIG. 3 by broken lines) to facilitate its conversion into an outer envelope 3'. In accordance with a presently preferred embodiment of the invention, each of the blanks 2 and 3 is weakened wherever its panels or fields are to be folded or pivoted relative to each other to thus facilitate the operation of folding means and to insure the making of packs 224 of predetermined outline and dimensions.

The material of blanks 2 and 3 is preferably a cardboard having a weight of not less than 150 grams per square meter and most preferably at least 200 grams or in excess of 200 grams per square meter.

The manner in which the blanks 1, 2, 3 are converted into corresponding components of a finished hinged-lid pack 224 is illustrated in FIGS. 1*a*, 1*b*, 2*a* and 3*a* to 3*l*. The conversion of these blanks into a pack 224 will be described with reference to FIGS. 4*a*, 4*b*, 4*c*, 4*d* and 5.

Figure 4A:
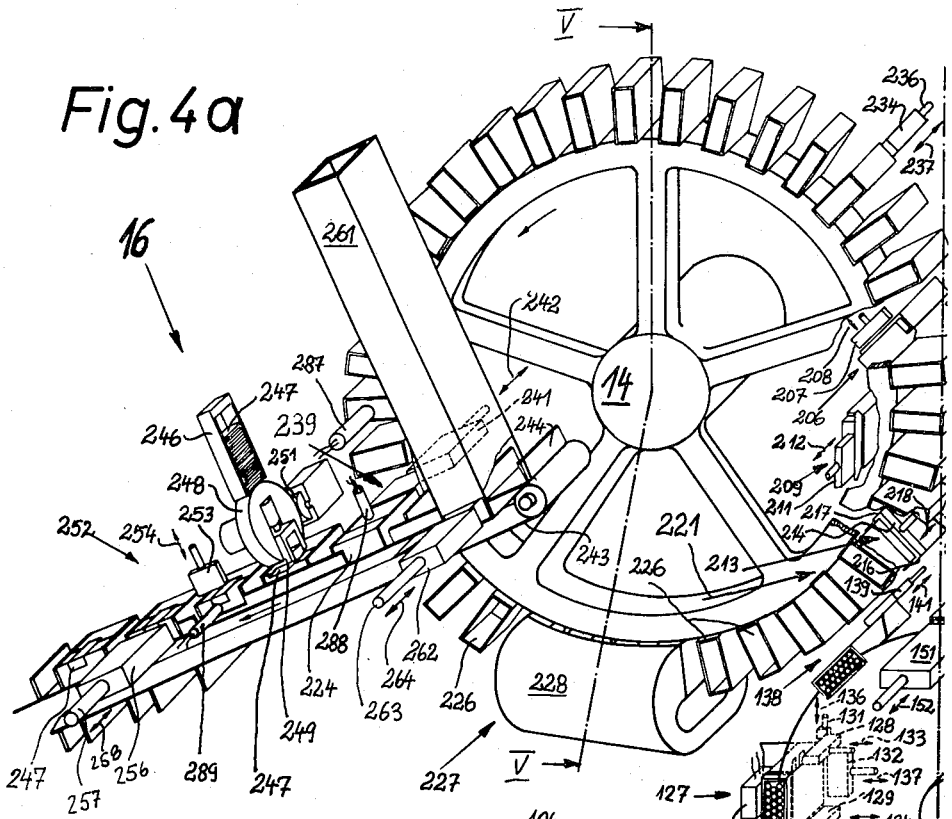
FIG. 4 (composed of FIGS. 4*a* and 4*b*) is a perspective view of the essential parts of a packing machine which embodies the improved apparatus.
FIG. 4*c* is a perspective view of the details of one of first holding means which are associated with each mandrel of the assembly conveyor in the packing machine of FIG. 4.
FIG. 4*d* is a perspective view of the details of one of second holding means which are associated with each mandrel of the assembly conveyor.
Figure 4C:
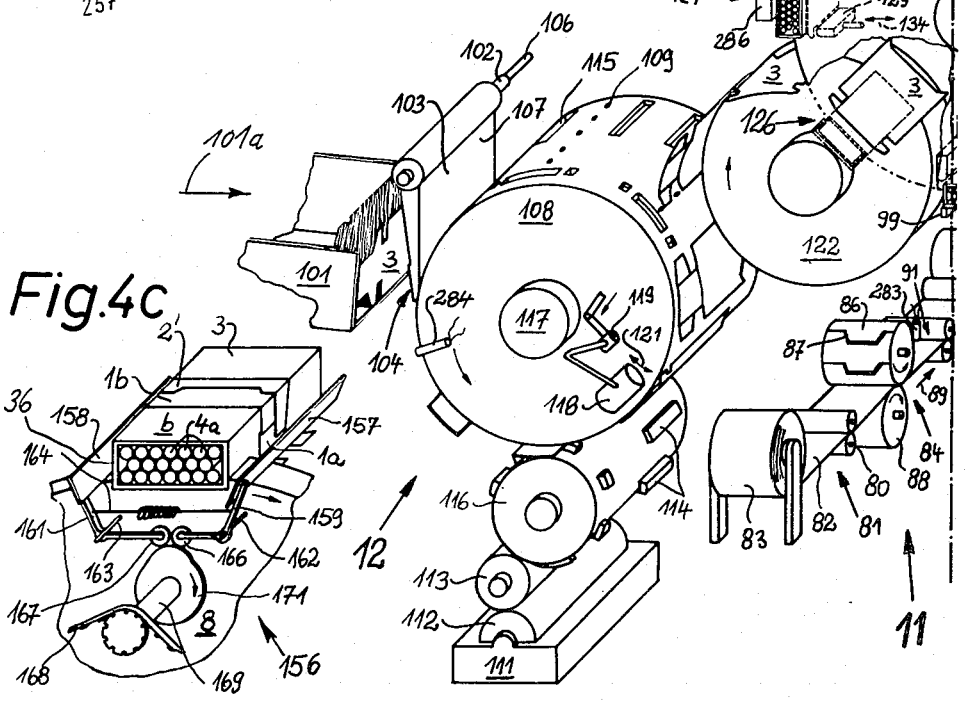
Figures 4B, 4D:
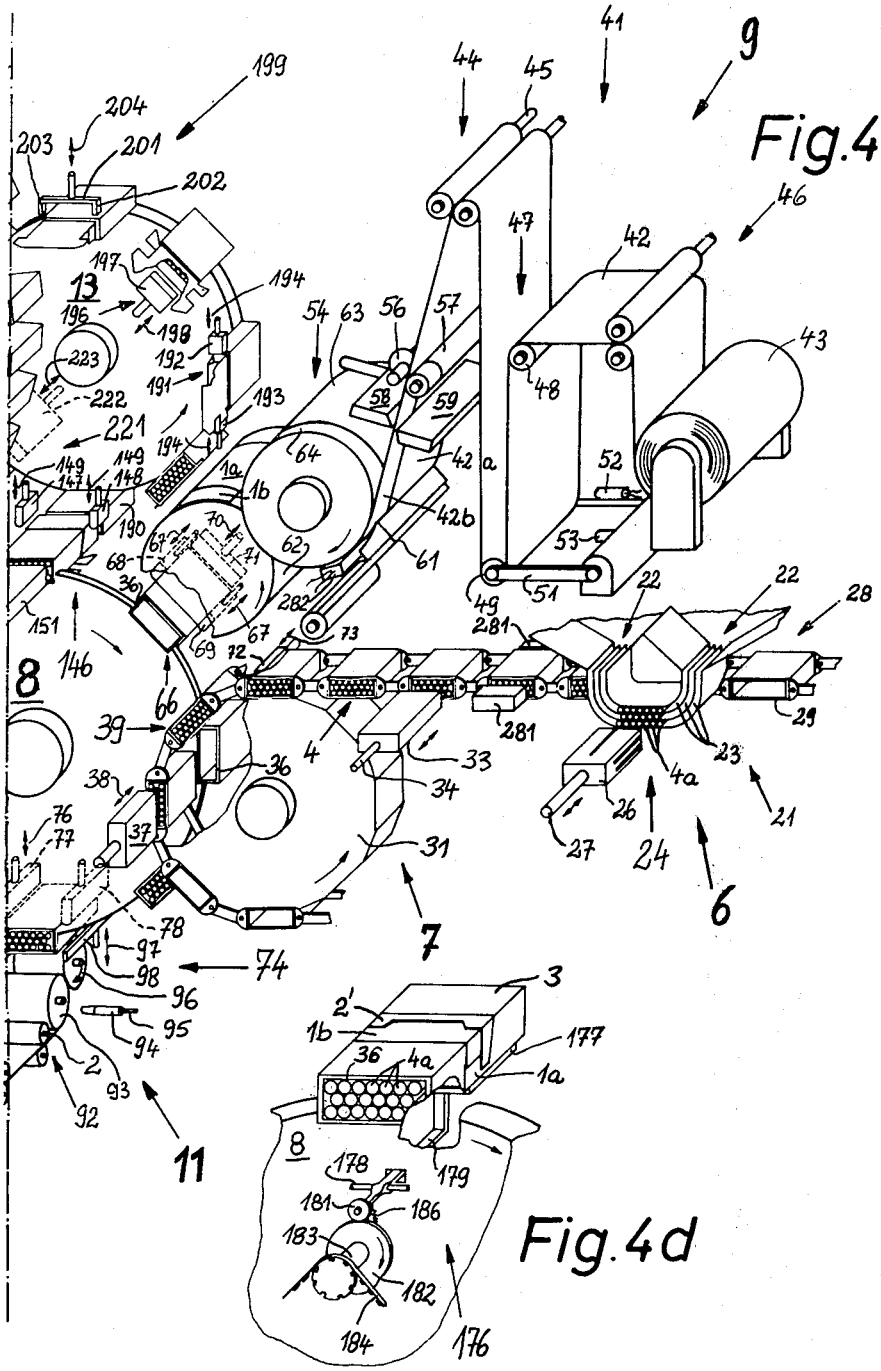

Referring now to FIGS. 4*a* and 4*b*, there are shown the main component parts of a packing machine which is utilized to convert blanks 1, 2 and 3 into hinged-lid packs 224 and to provide each such pack with a revenue label 247 (see FIG. 4*a*). The packing machine comprises the following main units: a block forming unit 6 which assembles groups or blocks 4 each of which consists of a predetermined number of filter cigarettes 4*a;* a block transporting unit 7 which serves to deliver blocks 4 of twenty filter cigarettes 4*a* each to an assembly conveyor 8 in the form of an intermittently rotated turret; a first blank feeding unit 9 which supplies to the turret 8 a succession of discrete composite foil blanks 1 of the type shown in FIG. 1; a second blank feeding unit 11 which serves to deliver to the turret 8 a succession of discrete blanks 2 of the type shown in FIG. 2; a third blank feeding unit 12 which serves to deliver to the turret 8 a succession of discrete prefabricated and adhesive-coated cardboard blanks 3 of the type shown in FIG. 3; a lid forming conveyor or turret 13 which converts portions of successive blanks 3 into pivotable lids of packs 224; a drying or conditioning conveyor 14 on which the adhesive of outer envelopes forming part of the packs 224 is heated so as to set and to prevent an opening of outer envelopes and their lids; and a labelling unit 16 which provides each pack 224 with a revenue label 247.

The various conveyors of the main units of the packing machine shown in FIGS. 4*a* and 4*b* include the aforementioned turrets 8 and 13, the conditioning conveyor 14 and several additional conveyors in the form of endless chains, belts or bands and drums which are used to transport filter cigarettes 4*a* as well as the blanks 1, 2, 3 and portions of assembled packs 224. All such conveyors are driven by a main prime mover of the packing machine in stepwise fashion and in synchronism with each other in a manner to be described later. The transmissions between the main prime mover of the packing machine and various conveyors may include clutches, geneva drives and/or other types of means for effecting stepwise movements of the respective conveyors. The main prime mover of the packing machine preferably further transmits motion to several reciprocable and/or pivotable components, such as folding members for the blanks 1, 2 and 3, retaining or holding means, transfer devices or pushers and ejecting devices or plungers. The reciprocatory and/or oscillatory movements of such component parts are synchronized with stepwise movements of the conveyors. The arrangement is assumed to be such that the oscillatory and/or reciprocatory parts are movable while the conveyors are at a standstill. Certain parts of the packing machine, such as various feeding and ejecting elements, are activated or deactivated by drive means which are set in motion in response to signals whenever the detectors of the packing machine detect defects in the condition and/or appearance of various components and/or the absence of certain components of packs 224. Such randomly operated drive means are also arrested in response to signals which can be produced by detectors, counters, shift registers or by hand. If the drive means are not specifically mentioned, they are operated continuously until arrested in response to electric signals or by hand.

Each cycle of operation of the packing machine consists of a plurality of successive working stages each of which includes a first interval during which the conveyors are in motion and a second interval during which the conveyors are at a standstill.

The block forming unit 6 comprises a magazine or hopper 21 which is provided with two main storing chambers 22 for filter cigarettes 4*a* of unit length. The storing chambers 22 communicate with three arcuate ducts 23 which can accumulate three rows or layers of filter cigarettes 4*a* (hereinafter called cigarettes for short). It is clear that the filter cigarettes 4*a* can be replaced by other rodshaped smokers' products, such as cigarillos, plain cigarettes or cigars. The central portions of the ducts 23 are located in three parallel horizontal planes, one above the other, and in the path of movement of a reciprocable transfer device or pusher 26 located at a block building and transferring station 24. The pusher 26 is reciprocable by a driver shaft 27 whereby it expels from the adjacent portions of the ducts 23 a block 4 of 20 cigarettes 4*a* whenever it performs a working stroke in a direction away from the observer of FIG. 4*b*. In the illustrated embodiment, the pusher 26 is designed to expel from the hopper 21 blocks 4 consisting of 20 cigarettes 4*a* each whereby each block 4 comprises two outer layers of seven cigarettes and a median layer of six cigarettes. The cigarettes of the median layer are assumed to be staggered sideways with reference to the cigarettes of the two outer layers. It is clear, however, that the pusher 26 can be designed to expel from the hopper 21 blocks which consist of more than or less than 20 cigarettes; for example, the pusher 26 can expel blocks consisting of two or more than three layers whereby each layer may but need not contain the same number of discrete rodshaped articles.

The block transporting unit 7 comprises an endless chain conveyor 28 which includes a number of equidistant cells 29. Each cell 29 is designed to receive a block 4 while the chain conveyor 28 is at a standstill and the aforemost empty cell 29 registers with the pusher 26 of the block forming unit 6. The chain conveyor 28 is trained over two or more sprocket wheels including the sprocket wheel 31 shown in FIG. 4*b*. This sprocket wheel is driven intermittently so as to place successive empty cells 29 into register with the pusher 26 of the block forming unit 6. The illustrated sprocket wheel 31 is assumed to receive torque from the main prime mover of the packing machine. The block building and transferring station 24 is followed by a station which accommodates a plunger 33 constituting an ejector for defective blocks 4. The plunger 33 is reciprocable transversely of the chain conveyor 28 by a drive shaft 34. When the drive means for the shaft 34 receives a signal, the plunger 33 performs a working stroke while the chain conveyor 28 is at a standstill whereby the plunger expels a defective block 4 from the registering cell 29.

The assembly conveyor or turret 8 comprises a number of equidistant hollow receiving means or mandrels 36 which travel stepwise along an endless path. Successive empty mandrels 36 receive blocks 4 of 20 cigarettes 4*a* each at a transfer station 39. The transfer device which is employed to transfer blocks 4 from successive filled cells 29 of the chain conveyor 28 into successive empty mandrels 36 at the transfer station 39 comprises a reciprocable pusher 37 which is movable in directions indicated by a double-headed arrow 38. The pusher 37 performs a working and a return stroke during successive intervals of idleness of the chain conveyor 28 and turret 8.

The first blank feeding unit 9 is shown in the upper right-hand portion of FIG. 4*b*. This blank feeding unit comprises a conveyor 41 which serves to transport a continuous web 42 of foil from a source or bobbin 43 toward a transfer station 66 where successive composite foil blanks 1 are transferred onto succesive mandrels 36 of the turret 8. The transporting conveyor 41 comprises two intermittently driven web advancing rolls 44 one of which is driven by a shaft 45. The drive shaft 45 can be arrested for a longer interval of time if it is desired to interrupt the delivery of composite blanks 1 to the turret 8. The conveyor 41 further comprises a pair of continuously driven web advancing rolls 46 and two guide rolls 48, 49 which form a loop 47 between the advancing rolls 46 and 44. It will be noted that the intermittently driven advancing rolls 44 are located downstream of the continuously driven advancing rolls 46, as considered in the direction of lengthwise movement of the web 42 from the source or bobbin 43 toward the transfer station 66. The lower guide roll 49 is mounted on a pivotable supporting arm 51. The length of the loop 47 is monitored by two photoelectric detectors 52 and 53 which cooperate with the pivotably mounted guide roll 49. The detectors 52 and 53 are in circuit with the controls for drive means of the continuously driven advancing rolls 46.

If the blank feeding unit 9 fails to deliver composite foil blanks 1, for example, because the chain conveyor 28 fails to deliver a succession of blocks 4 or for other reasons, the drive means for the intermittently operated advancing rolls 44 remains idle so that the length of the loop 47 between the advancing rolls 46 and 44 increases. This will be readily understood since the advancing rolls 46 are normally driven continuously to feed the web 42 toward the advancing rolls 44. As the length of the loop 47 increases, the guide roll 49 moves downwardly, as viewed in FIG. 4*b*, because the supporting arm 51 tends to pivot counterclockwise. Consequently, the guide roll 49 moves across the path of a light beam which issues from a light source and impinges upon the photosensitive element of the detector 53. The detector 53 then produces a signal which is used to arrest the drive means for the advancing rolls 46. As a result of stoppage of the advancing rolls 46, no further material is being withdrawn from the source or bobbin 43 so that the length of the loop 47 cannot increase and actually decreases as soon as the advancing rolls 44 are again set in rotary motion. In response to repeated stepwise rotary movements of the advancing rolls 44 (while the advancing rolls 46 are idle), the length of the loop 47 decreases in stepwise fashion whereby the arm 51 pivots clockwise, as viewed in FIG. 4*b*, and the guide roll 49 on the arm 51 moves from the path of the light beam issuing from a light source and being directed toward the photosensitive element of the detector 52. The detector 52 then produces a signal which is used to start the drive means for the advancing rolls 46. Consequently, the length of the loop 47 cannot decrease any further.

Figure 7:
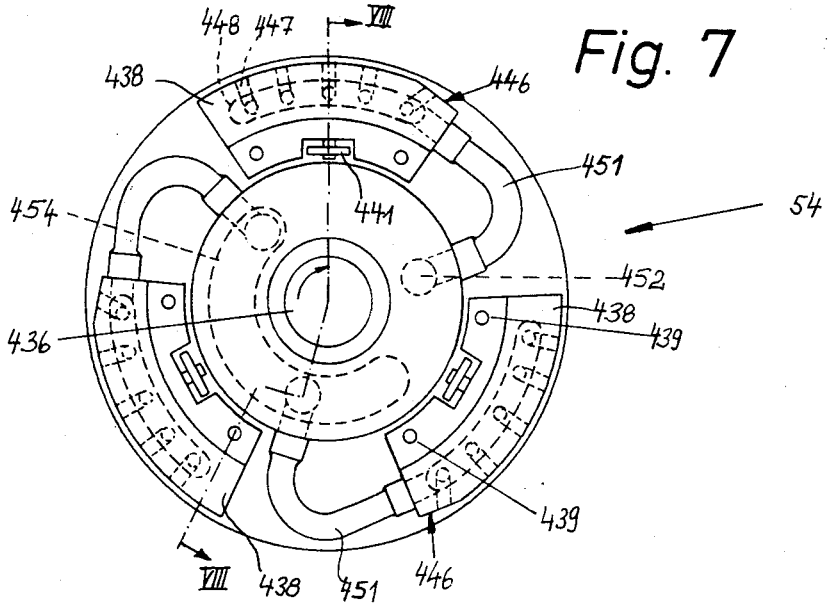
FIG. 7 is an enlarged transverse sectional view of a blank forming conveyor forming part of one of the blank feeding means in the packing machine of FIGS. 4*a* and 4*b*, the section being taken in the direction of arrows as seen from the line VII—VII of FIG. 8.
Figure 8:
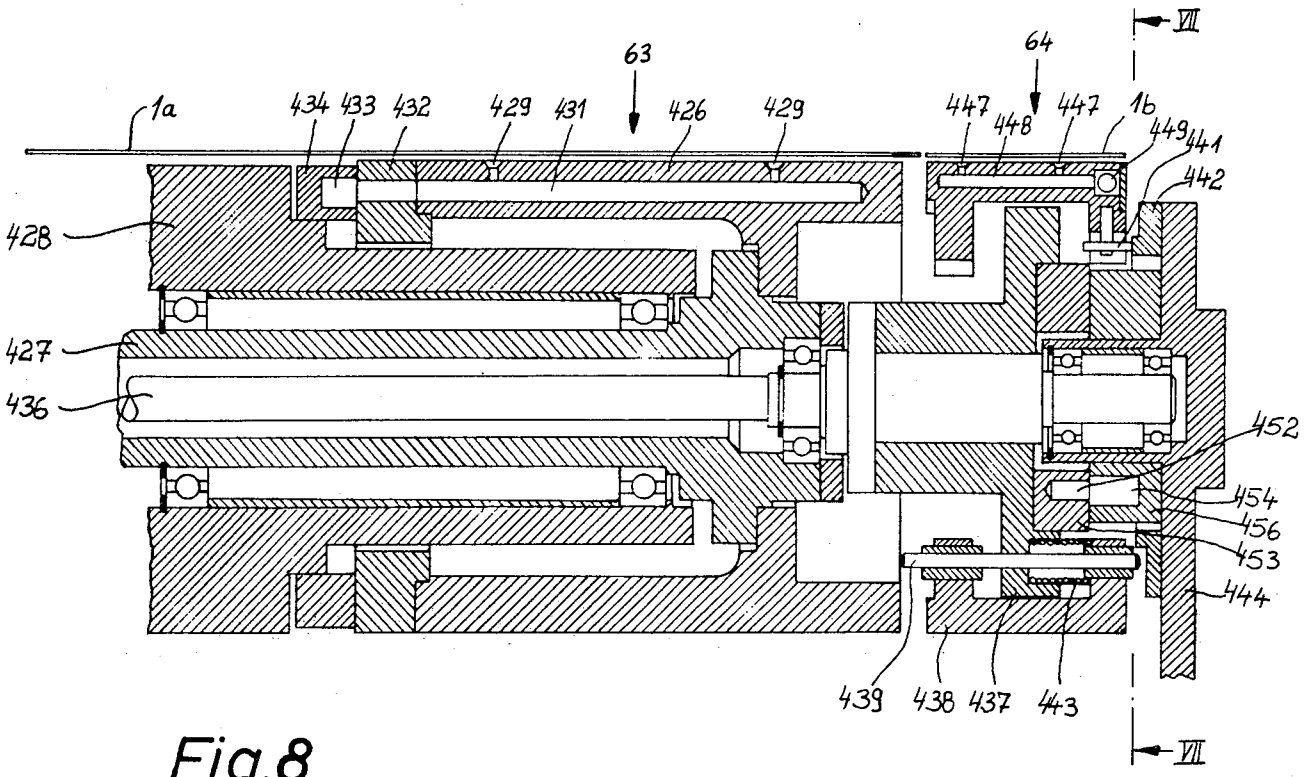
FIG. 8 is a sectional view as seen in the direction of arrows from the line VIII—VIII of FIG. 7.

The blank feeding unit 9 further comprises a blank forming conveyor 54 the details of which will be described with reference to FIGS. 7–10. The blank forming conveyor 54 is located downstream of the intermittently driven advancing rolls 44 and downstream of a rotary disk-shaped knife 56 which converts the web 42 into a pair of elongated strips 42*a* and 42*b* having different widths. The rotary knife 56 cooperates with a roller-shaped counterknife 57. The blank feeding unit 9 further comprises an intermittently operated knife 58 which cooperates with a stationary counterknife 59 to sever the strips 42*a* and 42*b* so as to form a succession of discrete blank sections 1*a* and 1*b* which are transferred onto the blank forming conveyor 54. The conveyor 54 is associated with an abutment 61 which serves to position the leading ends of successively formed sections 1*a* and 1*b* relative to retaining means provided on the conveyor 54 and serving to transport the blank sections during their conversion into composite blanks 1. The retaining means of the conveyor 54 are preferably suction ports which are shown in FIGS. 7 and 8. The arrangement is preferably such that the abutment 61 positions the leaders of strips 42*a* and 42*b* prior to severing of these strips to yield a pair of sections 1*a* and 1*b*. The composite blanks 1 which are delivered by the blank forming conveyor 54 are taken over by a transfer conveyor 62 for delivery to the turret 8. The blank forming conveyor 54 comprises two coaxial drums 63 and 64. The drum 63 receives the larger sections 1*a* and transports such larger sections during the interval of idleness of various conveyors at a speed which exceeds the speed of transport of smaller sections 1*b* by the drum 64. This results in staggering of sections 1*a* and 1*b*, as considered in the circumferential direction of the conveyor 54. The trailing section 1*b* is thereupon transported by the drum 64 while the drum 63 is idle and the section 1*b* is simultaneously moved axially of the drum 63 so as to partially overlap with the associated section 1*a* and to form therewith a composite blank 1. In a completed composite blank 1 (see FIG. 1), the sections 1*a* and 1*b* are accurately aligned with each other and one shorter side of the section 1*a* slightly overlaps the adjacent longer side of the section 1*b*.

The transfer conveyor 62 is located at the transfer station 66 which receives an empty mandrel 36 during each interval of idleness of the turret 8. The conveyor 62 is hollow and receives two folding members 68, 69 and a further folding member 71. The folding members 68, 69 and 71 respectively move back and forth in directions indicated by double-headed arrows 67 and 70 during each interval of idleness of the turret 8. The purpose of the folding members 68, 69 and 71 is to deform the composite blank 1 at the transfer station 66 so that the blank 1 assumes the shape shown in FIG. 1*a*. The thus deformed blank 1 partially surrounds the adjacent empty mandrel 36. A further folding member 72 is located at the transfer station 39 for the pusher 37. The purpose of the folding member 72 is to further deform the blank 1 on the adjacent mandrel 36 so that the blank 1 assumes the shape shown n FIG. 1*b* and almost completely surrounds the respective mandrel 36. The directions in which the folding member 72 is reciprocable during each interval of idleness of the turret 8 are indicated by a double-headed arrow 73.

Each composite blank 1 has a rectangular outline with two longer and two shorter sides. The orientation of blanks 1 on the transfer conveyor 62 is such that the longer sides of successive blanks 1 move sideways during transport toward successive mandrels 36 at the transfer station 66. This is desirable because the blanks 1 can be transported to the assembly conveyor 8 at a relatively low speed and also because such mode of transport facilities the placing of blank sections 1*a* and 1*b* into overlapping positions in a manner to be described in connection with FIGS. 7 and 8.

The transfer station for successive collar blanks 2 is shown at 74 in FIG. 4*b*. This transfer station receives two folding members 77, 78 which are reciprocable in directions indicated by a double-headed arrow 76 during each interval of idleness of the turret 8. The purpose of the folding members 77 and 78 is to fold the long side panels 1*a'* of successive foil blank sections 1*a* (see FIG. 2*a*).

The second blank feeding unit 11 is shown in the lower portions of FIGS. 4*a* and 4*b*. This feeding unit comprises a pair of advancing rolls 81 one of which is driven by a controlled drive shaft 80 and which serve to withdraw a continuous cardboard or stiff paper web or sheet 82 from a source or bobbin 83. The advancing rolls 81 deliver the sheet 82 into the range of a severing device 84 which includes a rotary severing drum 86 with suitably distributed blades 87 and a rotary counterknife 88 which constitutes a drum and is adjacent to the path of movement of the sheet 82 opposite the bladed severing drum 86. The distribution of blades 87 is such that they do not completely sever the sheet 82 all the way across between the marginal portions of the sheet so that the blanks 2 which are produced during travel of the sheet 82 between the drums 86 and 88 adhere to each other but can be readily separated in response to exertion of a pull upon the foremost blank 2. The direction in which the sheet 82 advances is indicated by an arrow 89. The means for separating successive blanks 2 from each other comprises two pairs of separating rolls 91 and 92 with the rolls 92 located downstream of the rolls 91, as considered in the direction of the arrow 89. The peripheral speed of the leading separating rolls 92 slightly exceeds the peripheral speed of the trailing separating rolls 91 whereby the sheet 82 is automatically subdivided into discrete blanks 2 which are thereupon taken over by a drum 93 to be delivered onto a transfer conveyor 96 at the transfer station 74. The separating rolls 91 are preferably provided with scoring or grooving rings to weaken selected portions (2F, 2G) of successive blanks 2 in regions indicated in FIG. 2 by broken lines. The drive shaft 80 for one of the advancing rolls 81 is kinematically coupled with the severing device 84 and with the separating rolls 91 so that the rolls 91 can be started or arrested simultaneously with the advancing rolls 81.

The drum 93 transports successive discrete blanks 2 past the orifice of an ejector nozzle 94 which is connected with a conduit 95 for admission of compressed air or another gaseous fluid. The purpose of the ejector nozzle 94 is to expel one or more blanks 2 so that such blanks cannot reach the transfer station 74 and cannot be delivered to successive mandrels 36 of the turret 8. The conduit 95 will be connected with a source of compressed air when the turret 8 should not receive blanks 2, for example, when the mandrel 36 reaching the transfer station 74 does not carry a deformed foil blank 1 and/or does not contain a block 4 of cigarettes 4*a*.

The transfer conveyor 96 at the station 74 is constructed and arranged to place the median panels or fields 2*a* of successive blanks 2 into contact with the composite blanks 1 on the adjacent mandrels 36. As shown in FIG. 2*a*, the placing of the panel 2*a* onto a blank 1 is such that the panel 2*a* overlies the overlapping portions of blank sections 1*a* and 1*b*. The transfer station 74 further accommodates two folding members 98 and 99 which are reciprocable in directions indicated by a double-headed arrow 97. The purpose of the folding members 98 and 99 is to deform the originally flat blanks 2 so that each such blank assumes the shape of a substantially U-shaped body or collar 2' shown in FIG. 2*a*. It will be noted that the conversion of blanks 2 into inserts or collars 2' takes place as soon as such blanks reach the mandrels 36 at the transfer station 74. The folding members 98 and 99 are actuated to move back and forth during each interval of idleness of the turret 8. As shown in FIG. 2*a*, the panels 2*b* and 2*c* overlap the long side panels 1*a'* of the deformed blank section 1*a*.

Figure 6A:
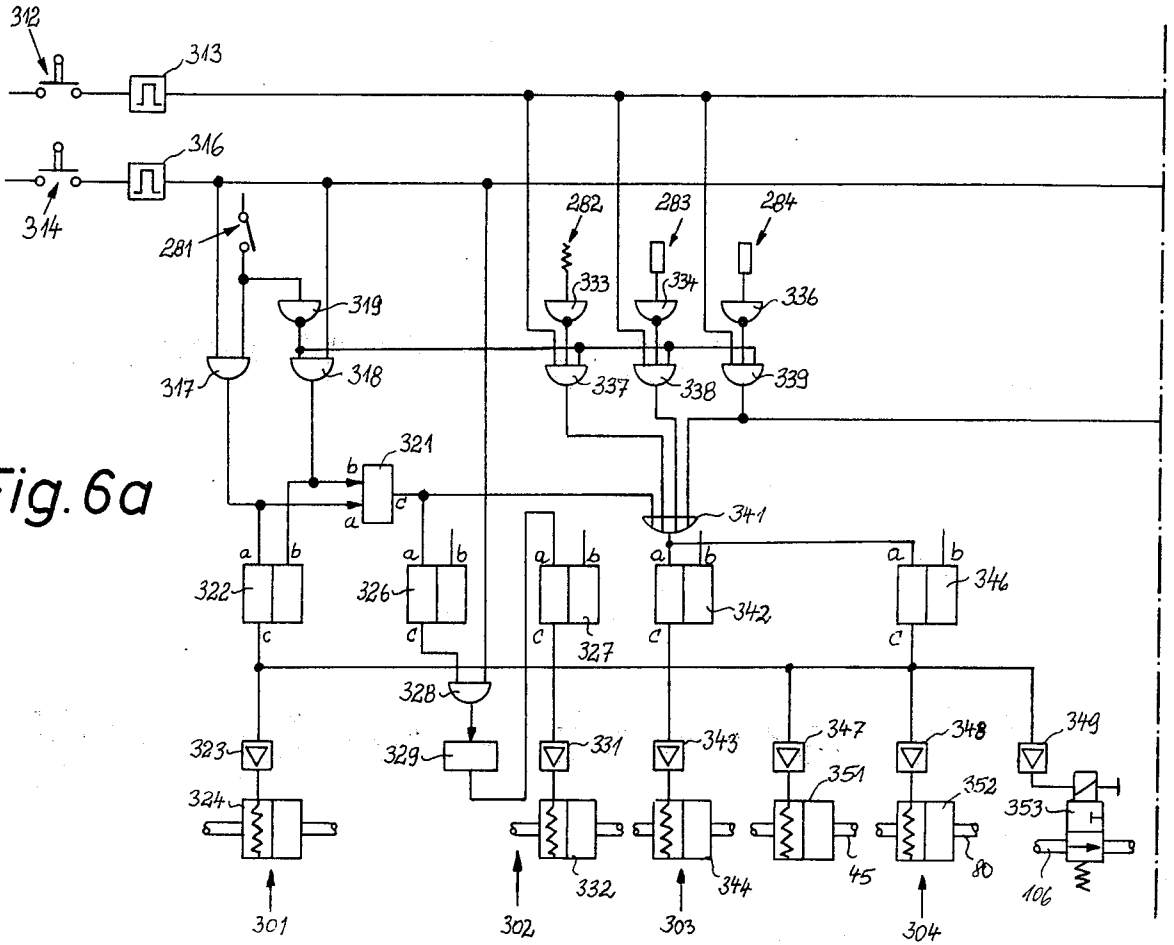
FIG. 6 (composed of FIGS. 6*a* and 6*b*) is a diagram of the control circuit of the packing machine shown in FIGS. 4*a* and 4*b;*

The feeding unit 12 for prefabricated cardboard blanks 3 of the type shown in FIG. 3 comprises a source or magazine 101 shown in the lower part of FIG. 4*a*. This magazine contains a stack of blanks 3 which are located in vertical or nearly vertical planes and the stack is pushed in a direction indicated by arrow 101*a* so that the foremost blank 3 is invariably located at the discharge end of the magazine 101. As shown in FIG. 3, each prefabricated blank 3 is provided with weakened portions (indicated by broken lines) so that it can be readily folded in a predetermined manner for conversion into the outer envelope 3' (FIG. 3 *l* ) of a finished hinged-lid pack 224. The means which serves to withdraw successive blanks 3 from the magazine 101 comprises a pivotable removing device 103 having a horizontal shaft 102 and being connected with a suction pipe 106. The surface 104 of the removing device 103 is provided with one or more suction ports (not shown) which communicate with the suction pipe 106 when the surface 104 is swung toward the discharge end of the magazine 101 whereby the surface 104 attracts and removes the foremost blank 3. The removing device 103 is pivoted to accept a fresh blank 3 while the turret 8 is at a standstill. The suction generating device which is connected to the pipe 106 is not shown in the drawing; such suction generating device may include a suitable fan or blower. The conduit 106 contains an electromagnetic valve 353 which is shown in FIG. 6*a*.

The removing device 103 has a second surface 107 which faces away from the magazine 101 and abuts against the periphery of a conveyor 108 when the removing device 103 is pivoted away from the foremost blank 3 in the magazine 101, i.e., when the surface 104 attracts a blank 3. The periphery of the conveyor 108 is provided with suction ports 109 which attract the blank 3 on the surface 104 and separate such blank from the removing device 103 in response to a counterclockwise rotation of the conveyor 108, as viewed in FIG. 4*a*.

A tank 111 contains a supply of adhesive paste and rotatably supports a withdrawing roller 112 which dips into the supply of paste in the tank 111 and transfers a film of adhesive onto a second roller or transfer roller 113. The roller 113 serves to coat with adhesive paste the protuberances 114 on a roller-shaped applicator 116 which, in turn, transfers adhesive paste from the protuberances 114 onto selected fields of a cardboard blank 3 which is being attracted to the periphery of the conveyor 108 by the suction ports 109. Referring to FIG. 3, the protuberances 114 on the roller-shaped applicator 116 of FIG. 4*a* are distributed in such a way that they coat with adhesive the fields *c,q,r,m,l,n* of successive cardboard blanks 3. The adhesive-coated portions of the fields *c,l,m,n,q* and *r* are indicated at P. In order to prevent contamination of the conveyor 108 by adhesive paste on the outer surfaces of protuberances 114 when the conveyor 108 does not carry blanks 3, the periphery of the conveyor 108 is provided with recesses or depressions 115 which register with the protuberances 114 and receive such protuberances without allowing the protuberances to touch the conveyor 108 when the latter does not carry any blanks 3.

The conveyor 108 is driven to rotate about a stationary shaft 117 which supports a folding member 118. The folding member is supported by the shaft 117 through the intermediary of a linkage including a pivot 119. The directions in which the folding member 118 moves back and forth while the conveyor 108 is at a standstill are indicated by a double-headed arrow 121. The purpose of the folding member 118 is to fold the fields *a* and *b* of successive cardboard blanks 3 over the respective fields *c* and *d* in a manner as shown in FIG. 3*a*.

The conveyor 108 delivers successive adhesive-coated blanks 3 to a transfer conveyor 122 which is provided with suction ports (not shown) serving to attract the blanks 3 during transport toward the mandrels 36 on the turret 8. The peripheral surface of the transfer conveyor 122 is also provided with recesses or depressions (not shown) similar to the recesses 115 on the conveyor 108 and serving the same purpose, namely, to prevent contamination of the transfer conveyor 122 by adhesive which has been applied to successive blanks 3 by the protuberances 114 of the applicator 116. The axial length of the transfer conveyor 122 is less than the axial length of the conveyor 108. Referring to FIG. 3, the axial length of the conveyor 122 is just sufficient to support the fields *h, i, k, l, m* and *n* of successive blanks 3. The non-supported fields *a–g* and *o–r* of successive blanks 3 are preferably guided by suitable guide means (not shown) while the fields *h–n* of successive blanks 3 are supported and transported by the transfer conveyor 122.

The axial position of the transfer conveyor 122 relative to the turret 8 of FIGS. 4*a* and 4*b* is selected in such a way that the fields *h–n* of a blank 3 carried by the conveyor 122 and reaching the transfer station 126 are located behind the adjacent mandrel 36. At the same time, the fields *a–e* of the respective blank 3 are transferred onto the adjacent unobstructed major panel 1*a*'' of the blank section 1*a* on the respective mandrel 36. This is best shown in FIG. 3*b* which illustrates that a properly applied and partially deformed cardboard blank 3 engages the deformed blank 1 on the respective mandrel 36 in such a way that the area of contact between the blanks 1 and 3 is located opposite the central panel 2*a* of the corresponding collar 2'. As shown in FIG. 3*b*, the deformed blank 1 is partially surrounded by the collar 2' and by the corresponding cardboard blank 3.

The transfer stations 66, 74 and 126 occupy three different portions of the endless path for the mandrels 36 of the turret 8. It will be noted that the transfer station 74 is located downstream of the transfer station 66 and upstream of the transfer station 126, as considered in the (clockwise) direction of travel of mandrels 36 about the axis of the turret 8.

The transfer station 126 is followed by a folding station 127 (as considered in the direction of intermittent rotation of the turret 8), and the folding station 127 accomodates five folding members including those numbered 128, 129, 131 and 132 as well as a further folding member which cannot be seen in FIG. 4*a*. The folding members at the station 127 perform reciprocatory movements while the turret 8 is at a standstill. The directions in which the folding members 128, 129, 131 and 132 are reciprocable are respectively indicated by double-headed arrows 133, 134, 136 and 137. The folding members 128 and 129 are moved in a first step and are followed by the folding member 131 and the non-illustrated folding member. The fifth folding member 132 is movable back and forth upon completion of reciprocatory movement of the folding member 131 and the non-illustrated folding member. The purpose of the folding members 128 and 129 is to fold the fields *f* and *h* (folding member 128) and *g* and *i* (folding member 129) of successive blanks 3. The folding member 131 cooperates with the non-illustrated folding member to fold the fields *h* and *i* of successive blanks 3 relative to the fields *f* and *g*. The folding member 132 serves to fold the fields *k–n* of successive blanks 3 (see FIG. 3*c*).

The folding station 127 is followed by a further folding station 138 which accommodates a folding member 139 reciprocable in directions indicated by a double-headed arrow 141 and being driven to perform such movements while the turret 8 is at a standstill. The purpose of the folding member 139 is to fold the fields *l,m* and *n* of successive blanks 3 in a manner as shown in FIG. 3*d*. It will be noted that, when the folding member 139 has completed a reciprocatory movement, the field *l* of the respective blank 3 abuts against the section 1*a* of the respective blank 1 and the outer side of the central field 2*a* of the corresponding collar 2'.

The folding station 138 is followed by a transfer station 146 which accommodates two discrete folding members 147 and 148. These folding members are actuated simultaneously during each interval of idleness of the turret 8 to move in directions indicated by the double-headed arrows 149 and serve to fold the fields *m* and *n* over the fields *f* and *g* of successive blanks 3 in a manner as illustrated in FIG. 3*e*. The transfer station 146 further accommodates a transfer device or pusher 151 which is reciprocable in directions indicated by a double-headed arrow 152 and serves to transfer successive blocks 4 from the respective mandrels 36 into the adjacent receptacles 190 of the lid forming conveyor or turret 13. It will be noted that the folding members which treat blanks on the mandrels 36 of the turret 8 are movable but do not share the angular movements of the turret 8.

The blanks which travel with the turret 8 must be held against movement relative to the respective mandrels 36 while the turret 8 is driven in stepwise fashion. Thus, the blanks 1 must be held against movement relative to the mandrels 36 during travel between the transfer stations 66 and 74. The blanks 1 and the blanks 2 must be held against movement relative to the respective mandrels 36 during travel between the transfer stations 74 and 126, and the blanks 1, 2 and 3 must be held against movement relative to the respective mandrels 36 during travel between the transfer stations 126 and 146. The structure for compelling the blanks 1 to travel with the respective mandrels 36 between the transfer stations 66 and 126 and then to the folding station 127 includes holding means 156 which are associated with each of the mandrels 36 and one of which is shown in detail in FIG. 4*c*. The holding means 156 of FIG. 4*c* comprises two holding members or flaps 157, 158 which are mounted on bell crank levers 159 and 161. The levers 159 and 161 are pivotably mounted on the turret 8 so as to turn on or with the shafts 162 and 163. A helical spring 164 couples the flaps 157 and 158 in such a way that the flaps tend to abut against the mandrels 36 whereby they press the blanks against the adjacent external surfaces of such mandrel. The bell crank levers 159 and 161 respectively carry roller followers 166 and 167 which cooperate with disk-shaped cams 171. The cam 171 shown in FIG. 4*c* is driven by a shaft 169 which receives torque from a toothed belt 168. The belt 168 receives motion from the main prime mover of the packing machine. A cam 171 is provided at the transfer station 66, at the transfer station 74, at the folding station 127, and at the transfer station 146.

When the mandrel 36 reaches a station which accommodates a cam 171 and the turret 8 is brought to a standstill, the rotating cam 171 causes the roller followers 166 and 167 to move apart and to thereby pivot the bell crank levers 159 and 161 in directions to move the flaps 157 and 158 away from the respective mandrel so that the blanks on such mandrel can be folded by the respective folding member or members. The continuously rotating cam 171 thereupon allows the roller followers 166 and 167 to follow the bias of the respective spring 164 which causes the flaps 157 and 158 to move toward the adjacent surfaces of the mandrel 36 whereby the blanks are again held against movement relative to the mandrel while the turret 8 advances by one or more steps.

Each mandrel 36 is further associated with holding means 176 serving to engage cardboard blanks 3 during travel from the transfer station 126 to the transfer station 146. One of the holding means 176 is shown in FIG. 4*d*. The illustrated holding means comprises a plate-like holder 177 which is pivotally connected to a lever 179. The lever 179 is pivotable about the axis of a shaft 178 which is mounted on the turret 8. The free end portion of the lever 179 carries a roller follower 181 which cooperates with rotary cams 182 (one shown in FIG. 4*d*). Such cams 182 are provided at the transfer station 39, at the transfer station 126 and at the transfer station 146. Each of the cams 182 is mounted on a camshaft 183 which is driven by the main prime mover of the packing machine by way of a toothed belt 184. A helical spring 186 is provided to urge the holder 177 against the mandrel 36 provided that the roller follower 181, which continuously tracks the adjacent cam 182, allows such pivotal movement of the holder 177.

When a mandrel 36 reaches the range of a cam 182, selected portions of such cam (which is continuously driven) impart a movement to the respective lever 179 through the intermediary of the roller follower 181 while the turret 8 is at a standstill. The roller follower 181 then pivots the lever 179 against the opposition of the spring 186 so that the lever pivots about the axis of the shaft 178 and moves the holder 177 away from the mandrel 36. This enables the folding members to perform their deforming or draping operations. During the next stage of rotation of the cam 182, the roller follower 181 allows the lever 179 to pivot under the action of the spring 186 so that the holder 177 returns into engagement with the adjacent portion of the blank 3 on the respective mandrel 36. The holder 177 then remains in such blank-engaging position during movement of the turret 8 in a direction to advance the respective mandrel 36 into the range of the next cam 182.

The transfer station 146 between the turret 8 and the lid forming turret 13 is followed by a folding station 191 which accommodates a pair of discrete folding members 192 and 193. These folding members are reciprocable in directions indicated by double-headed arrows 194 while the turret 13 is at a standstill. The purpose of the folding members 192 and 193 is to fold portions of composite foil blanks 1 in a manner as illustrated in FIG. 3*f*. Those portions of the blank sections 1*a* and 1*b* which are folded by the members 192 and 193 at the folding station 191 are denoted in FIG. 3*f* by the reference characters 1*ab*.

The folding station 191 is followed by a further folding station 196 for a folding member 197 which is reciprocable in directions indicated by a double-headed arrow 198 while the turret 13 is at a standstill. The purpose of the folding member 197 is to fold the portion 1*g* of the blank section 1*b* in a manner as shown in FIG. 3*g*.

The folding station 196 is followed by a folding station 199 for a folding member 201 which comprises two projections 202 and 203. While the turret 13 is at a standstill, the folding member 201 is caused to reciprocate in directions indicated by a double-headed arrow 204 to thereby fold the fields *o* and *p* of successive cardboard blanks 3 in a manner as illustrated in FIG. 3*h*.

Still another folding station 206 is located downstream of the folding station 199 and accommodates a folding member 207 which is reciprocable in directions indicated by a double-headed arrow 208 while the turret 13 is at a standstill. The purpose of the folding member 207 is to fold the fields *a*,*b*,*c*,*d*,*q* and *r* of successive cardboard blanks 3 in a manner as illustrated in FIG. 3*i*.

An additional folding station 209 is adjacent to the path of movement of receptacles 190 on the turret 13 and accommodates a folding member 211 which reciprocates in directions indicated by arrow 212 while the turret 13 is at a standstill. The purpose of the folding member 211 is to fold the fields *a*,*c*,*q* and *r* of successive cardboard blanks 3 in a manner as illustrated in FIG. 3*k*. It will be noted that the overlapping fields *a* and *c* of the cardboard blank 3 shown in FIG. 3*k* overlie the field 2*a* of the collar 2'.

The folding station 209 is followed by a further folding station 213 for a folding member 214 including projections 216, 217 and being reciprocable in directions indicated by a double-headed arrow 218 while the turret 13 is at a standstill. The folding member 214 thereby folds the fields *q* and *r* over the fields *o* and *p* in a manner as illustrated in FIG. 3*l*. This completes the formation of a finished hinged-lid pack 224.

Figure 5:
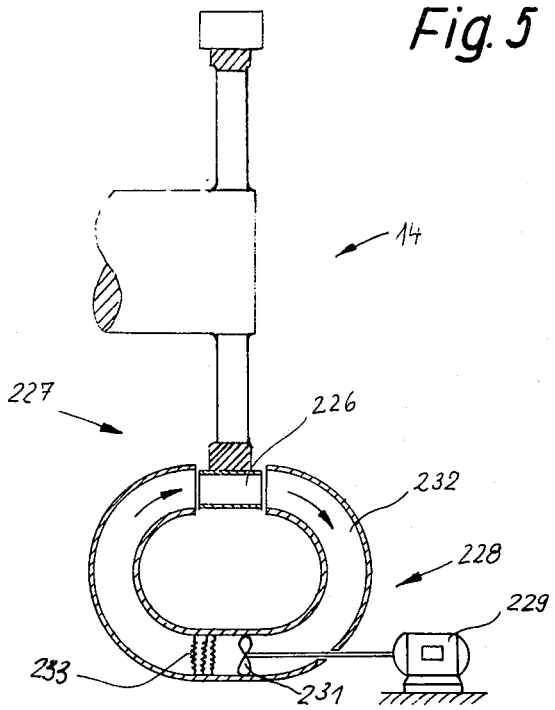
FIG. 5 is a sectional view as seen in the direction of arrows from the line V—V of FIG. 4*a;*

The folding station 213 is followed by a transfer station 221 for a transfer device or pusher 222 which is caused to perform a reciprocatory movement (see the double-headed arrow 223) during each interval of idleness of the turret 13 and conditioning conveyor 14. The purpose of the pusher 222 is to transfer finished packs 224 from successive receptacles 190 of the turret 13 into successive containers 226 of the conditioning conveyor 14. The conditioning conveyor 14 resembles a wheel which carries a plurality of equidistant containers 226 each of which has two open ends, as considered in the axial direction of the conveyor 14, and each of which is located in a substantially radial plane of the conditioning conveyor. Prior to reaching the transfer station 221, successive empty containers 226 of the conditioning conveyor 14 advance toward, through and beyond a heating zone 227 for a blower 228 the details of which are illustrated in FIG. 5. The blower 228 includes an electric motor 229 which drives a fan 231 whereby the fan 231 circulates a stream of air in a channel 232 containing an electric resistance heater 233. The direction in which the air stream flows in the channel 232 is indicated by the arrows shown in FIG. 5. The channel 232 is interrupted at its apex to provide room for entry of successive empty containers 226 whereby the stream of air flows through the container 226 which happens to be in register with the adjacent portions of the channel 232. In this manner, the stream of air which is heated during flow past the electric resistance heater 233 preheats successive containers 226 before such containers reach the transfer station 221 to receive finished packs 224. It can be said that the container 226 which assumes the position shown in the central portion of FIG. 5 forms part of the channel 232 whereby the walls of such container are heated sufficiently to insure satisfactory conditioning of adhesive on the cardboard blank 3 of the pack 224 which is to be transferred into the container at the station 221.

The transfer station 221 for the pusher 222 is followed by an expelling device including a plunger 234 having a shaft 226 the drive means for which is responsive to electric signals whereby the plunger 234 moves in directions indicated by a double-headed arrow 237 and expels the adjacent pack 224 from the container 226 which happens to register with the plunger 234. If the plunger 234 is caused to perform a working and a return stroke, such movements of the plunger 234 invariably take place while the conditioning conveyor 14 is at a standstill so that the plunger registers with one of the filled containers 226.

The expelling device including the plunger 234 is followed by a transfer station 239 for a transfer device or pusher 241 which serves to transfer packs 224 from successive containers 226 into successive sockets 244 of a conveyor belt 243. The pusher 241 is reciprocable in directions indicated by a double-headed arrow 242 while the conditioning conveyor 14 is at a standstill whereby the expelled pack 224 enters the registering socket 244 of the conveyor belt 243. The conveyor belt 243 serves to transport a row of packs 224 into the range of the labelling unit 16 which includes a magazine 246 for a stack of revenue labels 247. The lowermost label 247 in the magazine 246 is removable by a conveyor 248 which is provided with a ram 249 having suction ports (not specifically shown) so as to attract a label 247 during transport along a paster 251 whereby the paster coats the exposed side of the label 247 with a film of adhesive before the thus coated label is attached to the adjacent pack 224 on the conveyor belt 243. The label removing conveyor 248 is followed by a folding or draping station 252 for a folding or draping member 253 which is reciprocable in directions indicated by a double-headed arrow 254 while the conveyor belt 243 is at a standstill. The ram 249 of the conveyor 248 applies revenue labels 257 to successive packs 224 in the adjacent sockets 244 of the conveyor belt 243 in such a way that a portion of the label extends beyond the respective pack. Such portions of the labels are thereupon folded or draped by the member 253.

The folding station 252 is followed by a station for an expelling device or plunger 256 which is mounted on a shaft 257 and is reciprocable by this shaft in directions indicated by a double-headed arrow 258 while the conveyor belt 243 is at a standstill. The drive means for the shaft 257 is responsive to signals so that the plunger 256 can eject from the respective sockets 244 those packs which do not carry revenue labels 247.

The labelling unit 16 is preceded by a magazine in the form of an upright tower 261 which can receive a stack of packs 224. The tower 261 can receive packs 224 which are expelled from sockets 244 by the plunger 256. The means for transferring packs from the belt 243 into the tower 261 is not shown in the drawing; such transfer can also be effected by hand. As a rule, the packs which are expelled by the plunger 256 are quite satisfactory except that they are not provided with revenue labels 247. The lower end portion of the tower 261 is adjacent to a reciprocable removing device or pusher 262 which can be moved back and forth in directions indicated by a double-headed arrow 264. The shaft 263 of the pusher 262 receives motion from a drive means (not shown) which serves to introduce packs 224 into empty sockets 244 of the conveyor belt 243. In this manner, the pusher 262 supplies to the conveyor belt 243 packs which are missing due to absence of packs in certain containers 226 of the conditioning conveyor 14.

Referring again in FIG. 4*b*, a detector 281 (preferably a twin or dual detector) is positioned adjacent to the path of movement of cells 29 on the chain conveyor 28. This detector is mounted between the station 24 and the station which receives the plunger 33. The purpose of the detector 281 is to monitor the blocks 4 in successive cells 29 and to produce signals in response to detection of any defects, such as unsatisfactory ends of tobacco-containing portions of the cigarettes 4*a*, the absence of one or more cigarettes 4*a*, and/or the absence of one or more filter tips.

A second detector 282 is adjacent to the blank forming conveyor 54 of the first blank feeding unit 9 (see FIG. 4*b*). The detector 282 produces signals in response to detection of the absence of composite blanks 1. For example, the detector 282 can constitute a so-called proximity initiator which produces a signal in response to detection of the absence of metal (namely, the metallic portions of blanks 1) in the path defined by the periphery of the blank forming conveyor 54.

A third detector 283 is installed in the blank feeding unit 11 (see FIG. 4*a*) between the severing device 84 and the separating rolls 91. The detector 283 is preferably a photoelectric detector which produces a signal in response to detection of the absence of blanks 2.

A detector 284 (preferably a photoelectric detector) is adjacent to the periphery of the conveyor 108 in the blank feeding unit 12 of FIG. 4*a*. The purpose of the detector 284 is to produce signals in response to detection of the absence of cardboard blanks 3 on the conveyor 108.

The folding station 127 which is adjacent to the path of movement of mandrels 36 on the turret 8 receives a fifth detector 286 which is preferably a four-way detector and is designed to determine the presence or absence of any or all components of a pack 224 on and in the adjacent mandrel 36. The detector 286 produces a signal when the adjacent mandrel 36 does not carry a section 1*a* or 1*b*, a collar 2' and/or a cardboard blank 3 and/or does not contain a block 4.

The transfer station 239 between the conditioning conveyor 14 and conveyor belt 243 receives a further detector 287 which produces signals in response to detection of the absence of packs 224 in the adjacent containers 226. The detector 287 is preferably a photoelectronic detector, and a similar detector 288 is provided immediately downstream of the transfer station 239 to produce signals in response to detection of the absence of packs 224 in the adjacent sockets 244 of the conveyor belt 243.

A further photosensitive detector 289 is located downstream of the labelling unit 16 to produce signals in response to detection of packs 224 which do not carry revenue labels 247.

Figure 6B:
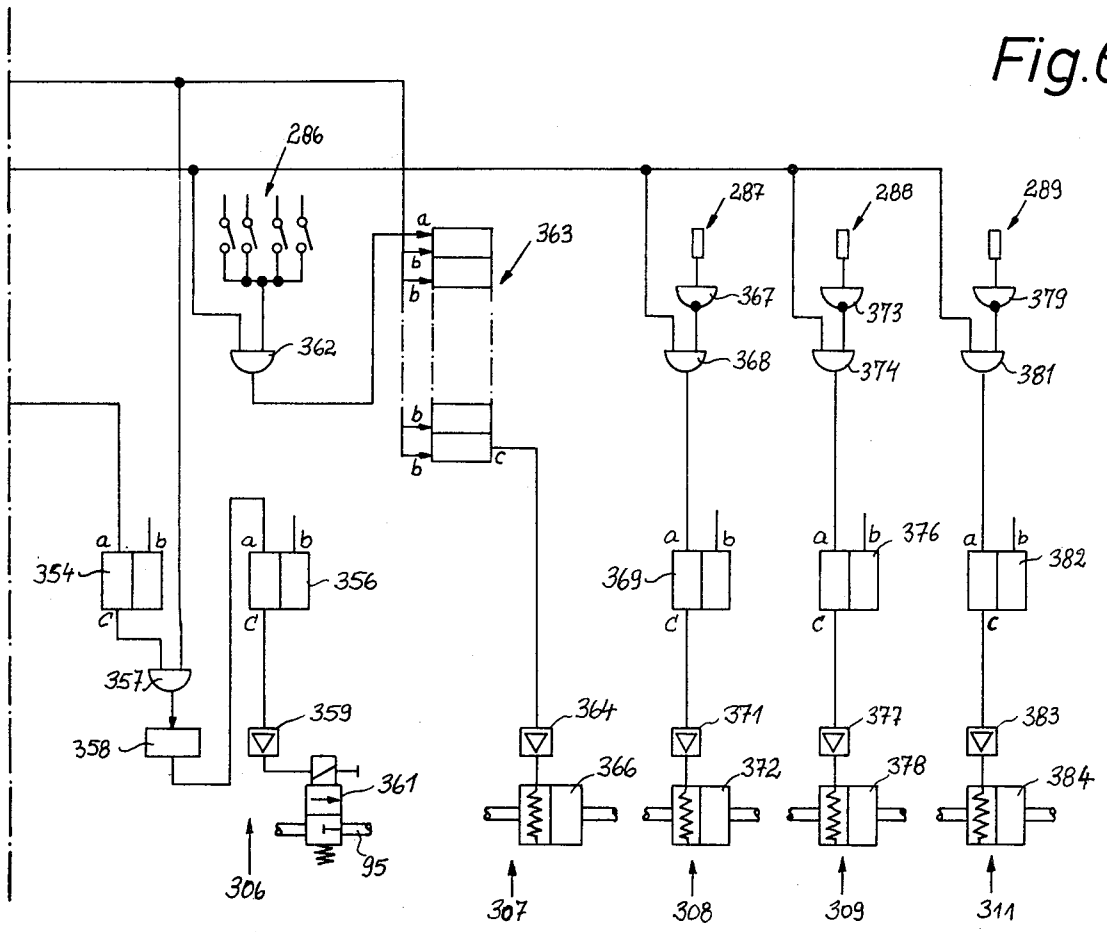

FIGS. 6*a* and 6*b* illustrate a control circuit which includes the detectors 281–284 and 286–289 and converts signals furnished by these detectors into control signals for actuation of various parts of the packing machine shown in FIGS. 4*a* to 4*d*. The control circuit includes nine units or branches 301–304, 306–309 and 311.

The control circuit branch 301 includes the twin detector 281 and serves to regulate the movements of the ejector plunger 33 shown in FIG. 4*b* so that the plunger 33 expels a block 4 from the adjacent cell 29 of the chain conveyor 28 when the detector 281 indicates the absence of one or more cigarettes 4*a*, the presence of one or more defective tobacco-containing portions and/or the absence of one or more filter tips.

The branch 302 of the control circuit shown in FIGS. 6*a* and 6*b* controls an electromagnetic clutch 332 which can be said to form part of the main prime mover of the packing machine.

The control circuit branch 303 produces signals which interrupt the movements of the pusher 26 at the transfer station 24 of FIG. 4*b*. This branch includes the detectors 282, 283 and 284 and serves to interrupt the movements of the pusher 26 in response to detection of the absence of a composite blank 1 (detector 282), a blank 2 (detector 283) and/or a blank 3 (detector 284).

The branch 304 of the control circuit regulates the movements of advancing rolls 44 in the blank feeding unit 9, the movements of advancing rolls 81 in the blank feeding unit 11, and the connection between a suction generating device and the suction ports in the surface 104 of the removing device 103 in the blank feeding unit 12.

The branch 306 controls the admission of compressed gaseous fluid to the ejector nozzle 94 in the blank feeding unit 11.

The branch 307 controls the movements of the expelling plunger 234 which is adjacent to the path of movement of containers 226 on the conditioning conveyor 14. This branch includes the four-way detector 286.

The branch 308 includes the detector 287 and controls the movements of the pusher 262 which transfers packs 224 from the tower 261 into the sockets 244 of the conveyor belt 243.

The branch 309 includes the detector 288 and serves to control the label removing conveyor 248 of the labelling unit 16.

The branch 311 includes the detector 289 and serves to control the movements of the plunger 256 which expels unlabelled packs 224 from the sockets 244 of the conveyor belt 243 downstream of the labelling unit 16.

The main prime mover further drives two rotary cams (not specifically shown) one of which actuates a signal generating device 312 and the other of which actuates a signal generating device 314, both shown in the upper portion of FIG. 6*a*. These signal generating devices are shown in the form of normally open electric switches and are respectively connected with pulse shapers 313 and 316. The switch 312 produces signals during the intervals of movement of conveyors in the packing machine of FIGS. 4*a* to 4*d*, and the switch 314 produces signals during the intervals of idleness of the conveyors. The switches 312, 314 and the pulse shapers 313, 316 form part of the control circuit.

Referring in greater detail to the branches 301-304, 306-309 and 311 of the control circuit shown in FIGS. 6*a* and 6*b*, and first to the branch 301, this branch comprises the aforementioned detector 281 for defective blocks 4, two AND-gates 317, 318, a NO-gate 319, a counter 321, a signal storing device 322 of the type known as flip-flop, an amplifier 323 and an electromagnetic clutch 324. The detector 281 is connected with one input of the AND-gate 317, and the other input of this AND-gate is connected with the pulse shaper 316. The output of the AND-gate 317 is connected with the setting input *a* of the flip-flop 322 and with the counting input *a* of the counter 321. The output *c* of the flip-flop 322 is connected with the winding of the electromagnetic clutch 324 by way of the amplifier 323. When the winding is energized, it establishes a torque-transmitting connection between the driving and driven elements of the clutch 324 so that the plunger 33 then performs working and return strokes.

The detector 281 is further connected with one input of the AND-gate 318 by way of the NO-gate 319, and the other input of the AND-gate 318 is connected with the pulse shaper 316. The output of the AND-gate 318 is connected with the erasing input *b* of the flip-flop 322 and with an erasing input *b* of the counter 321.

The branch 302 of the control circuit comprises two flip-flops 326, 327, an AND-gate 328, a counter 329, an amplifier 331 and the electromagnetic clutch 332. The setting input *a* of the flip-flop 326 is connected with the output *c* of the counter 321 in the control circuit branch 301, and the output *c* of the flip-flop 326 is connected with one input of the AND-gate 328. The other input of the AND-gate 328 is connected with the pulse shaper 316. The output of the AND-gate 328 is connected with one input of the counter 329, and the output of this counter is connected with the setting input *a* of the flip-flop 327. The output *c* of the flip-flop 327 is connected with the winding of the electromagnetic clutch 332 by way of the amplifier 331. When the winding is energized, it terminates the torque-transmitting connection between the driving and driven elements of the clutch 332.

The branch 303 of FIG. 6*a* includes the detectors 282, 283, 284, three NO-gates 333, 334, 336, three AND-gates 337, 338, 339, an OR-gate 341, a flip-flop 342, an amplifier 343, and an electromagnetic clutch 344. The central inputs of the AND-gates 337, 338, 339 are respectively connected with the detectors 282, 283, 284 by way of the NO-gates 333, 334, 336. The outputs of the AND-gates 337, 338, 339 are connected with different inputs of the OR-gate 341. The left-hand inputs of the AND-gates 337-339 are connected with the pulse shaper 313. A further input of the OR-gate 341 is connected with the output *c* of the counter 321 in the control circuit branch 301. The output of the OR-gate 341 is connected with the setting input *a* of the flip-flop 342, and the output *c* of the flip-flop 342 is connected with the winding of the electromagnetic clutch 344 by way of the amplifier 343. When the winding is energized, it terminates the transmission of torque from the driving to the driven element of the clutch 344. The right-hand inputs of the AND-gates 337–339 are connected with the output of the NO-gate 319 in the branch 301.

The branch 304 comprises a flip-flop 346, three amplifiers 347, 348, 349, two electromagnetic clutches 351, 353 and the electromagnetic valve 353. The setting input *a* of the flip-flop 346 is connected with the output of the OR-gate 341 in the branch 303, and the output *c* of this flip-flop is respectively connected with the windings of the clutches 351, 352 and with the solenoid of the valve 353 by way of the amplifiers 347, 348 and 349. The amplifiers 347–349 are further connected with the output *c* of flip-flop 322 in the branch 301. The energization of windings of the clutches 351, 352 results in termination of transmission of torque from the respective driving to the associated driven clutch elements. The energization of solenoid results in closing of the valve 353 to terminate the flow of air from the ports of the surface 104 shown in FIG. 4*a* to the respective suction generating device by way of the pipe 106.

The branch 306 comprises two flip-flops 354, 356, an AND-gate 357, a counter 358, an amplifier 359 and an electromagnetic valve 361. The setting input *a* of the flip-flop 354 is connected with the output of the AND-gate 339 in the control circuit branch 303, and the output *c* of this flip-flop is connected with one input of the AND-gate 357. The other input of the AND-gate 357 is connected with the pulse shaper 313. The output of the AND-gate 357 is connected with the input of the counter 358 and the output of this counter is connected with the setting input *a* of the flip-flop 356. The output *c* of the flip-flop 356 is connected with the solenoid of the electromagnetic valve 361 by way of the amplifier 359. The energization of solenoid results in opening of the valve 361 so that the conduit 95 conveys a stream of pressurized fluid to the ejector nozzle 94 which expels one or more blanks 2 from the periphery of the drum 93 so that such blanks cannot reach the turret 8.

The branch 307 includes the four-way detector 286, an AND-gate 362, a shift register 363, an amplifier 364 and an electromagnetic clutch 366. The detector 286 is connected with one input of the AND-gate 362 the other input of which is connected with the pulse shaper 316 and the output of which is connected with the signal-receiving input *a* of the shift register 363. The inputs *b* of the shift register 363 are connected with the pulse shaper 313 to advance the signal which is furnished to the input *a* by the AND-gate 362. The output *c* of the shift register 363 is connected with the winding of the electromagnetic clutch 366 by way of the amplifier 364. When the winding is energized, it establishes a torque-transmitting connection between the driving and driven elements of the clutch 366 so that the plunger 234 performs working and return strokes.

The branch 308 includes the detector 287, a NO-gate 267, an AND-gate 368, a flip-flop 369, an amplifier 371 and an electromagnetic clutch 372. The detector 287 is connected with one input of the AND-gate 368 by way of the NO-gate 367, and the other input of the AND-gate 368 is connected with the pulse shaper 316. The output of the AND-gate 368 is connected with the setting input *a* of the flip-flop 369, and the output *c* of this flip-flop is connected with the winding of the electromagnetic clutch 372 by way of the amplifier 371. When the winding is energized, it establishes a torque-transmitting connection between the driving and driven elements of the clutch 372 so that the pusher 262 performs working and return strokes.

The branch 309 includes the detector 288, a NO-gate 373, an AND-gate 374, a flip-flop 376, an amplifier 377 and an electromagnetic clutch 378. The detector 288 is connected with one input of the AND-gate 374 by way of the NO-gate 373, and the other input of the AND-gate 374 is connected with the pulse shaper 316. The output of the AND-gate 374 is connected with the setting input *a* of the flip-flop 376; the output *c* of this flip-flop is connected with the winding of the electromagnetic clutch 378 by way of the amplifier 377. When the winding is energized, it terminates the transmission of torque from the driving to the driven element of the clutch 378 so that the conveyor 248 ceases to remove labels 247 from the magazine 246.

The branch 311 includes the detector 289, a NO-gate 379, an AND-gate 381, a flip-flop 382, an amplifier 383 and an electromagnetic clutch 384. The detector 289 is connected with one input of the AND-gate 381 by way of the NO-gate 379, and the other input of the AND-gate 381 is connected with the pulse shaper 316. The output of the AND-gate 381 is connected with the setting input *a* of the flip-flop 382; the output *c* of this flip-flop is connected with the winding of the electromagnetic clutch 384 by way of the amplifier 383. When the winding is energized, it establishes a torque-transmitting connection between the driving and driven elements of the clutch 384 so that the plunger 256 performs working and return strokes.

The erasing inputs *b* of the flip-flops 326, 327, 342, 346, 354, 356, 369, 376 and 382 receive signals in response to starting of the packing machine to thus erase the signals at the outputs *c* of the respective flip-flops.

FIGS. 7 and 8 illustrate the details of the blank forming conveyor 54 in the feeding unit 9 of FIG. 4*b*. The conveyor 54 comprises the aforementioned coaxial drums 63 and 64 the first of which includes a cylindrical body 426 fixedly secured to a hollow drive shaft 427. The latter is rotatably mounted in a stationary bearing member 428 forming part of or secured to the frame of the packing machine. The peripheral surface of the cylindrical body 426 is provided with first retaining means in the form of suction ports 429 which attract the blank sections 1a during travel of such sections with the drum 63. The inner ends of the ports 429 communicate with axially parallel channels 431 which, in turn, communicate with the arcuate groove 433 of a stationary valve plate 434 in selected angular positions of the drum 63. The valve plate 434 is secured to the bearing member 428. An apertured ring 432 is interposed between the left-hand axial end of the cylindrical body 426 (as viewed in FIG. 8) and the valve plate 434 to rotate with the body 426. The groove 433 is connected with the inlet of a suitable suction generating device, not shown. A row of suction ports 429 will communicate with the groove 433 during travel of such ports between the abutment 61 and the transfer conveyor 62 of FIG. 4*b*.

The drum 64 of the blank forming conveyor 54 comprises a hub 437 which is secured to a drive shaft 436. The latter extends through the hollow drive shaft 427 for the cylindrical body 426 of the drum 63. The hub 437 supports three segment-shaped holders 438 for the blank sections 1*b*. Each of the holders 438 is shiftable axially on two discrete shafts 439 which are parallel to the drive shafts 427 and 436. The holders 438 carry roller followers 441 which track the adjacent end face of a stationary ring-shaped shifting cam 442 secured to a frame member or wall 444 of the packing machine. The roller followers 441 are biased against the shifting cam 442 by helical springs 443. As the drive shaft 436 rotates, it causes the roller followers 441 to track the face of the shifting cam 442 whereby the holders 438 move axially of the shaft 436 in selected angular positions of the drum 64. One end of the drive shaft 436 is journalled in antifriction bearing means provided therefor in the wall 444.

The external surface of each holder 438 is provided with a flat or facet 446 and with retaining means in the form of suction ports 447 which communicate with axially parallel channels 448. Each channel 448 communicates with a discrete channel 449 which is connected with a flexible hose 451. The hoses 451 communicate with channels 452 of a ring 453 on the hub 437 and the channels 452 communicate with the arcuate groove 454 of a stationary valve plate 456 which is coaxial with the hub 437. Thus, the suction ports 447 of the holders 438 are connected with a suction generating device by way of the valve plate 456 in predetermined angular positions of the respective holders 438 whereby such holders attract the blank sections 1*b*.

The diameter of the cylinder including the convex peripheral surfaces of the holders 438 is slightly smaller than the diameter of the cylindrical body 426 of the drum 63.

Figure 9:
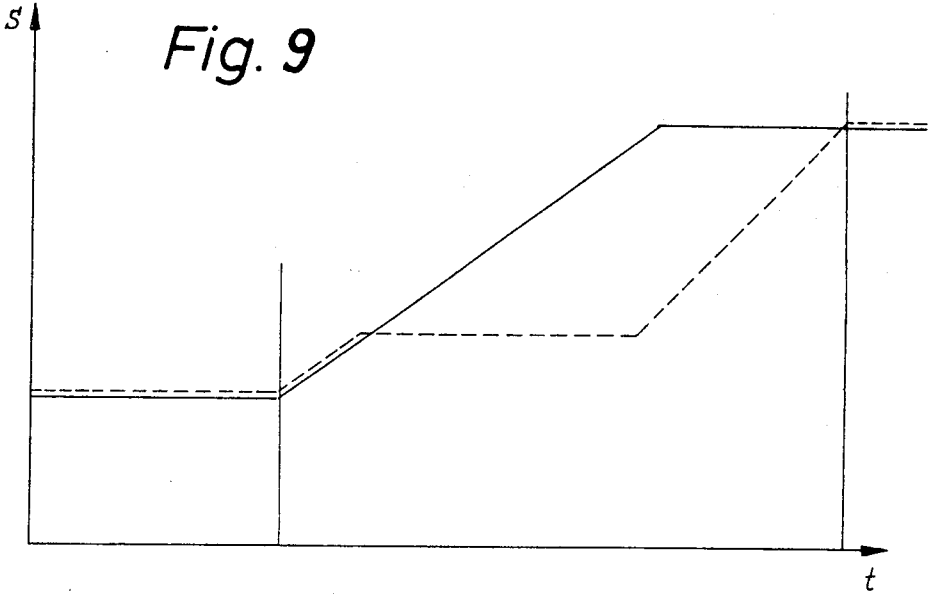
FIG. 9 is a diagram whose curves indicate the distances covered by the sections of blanks of the type shown in FIG. 1 during transport by the blank forming conveyor of FIGS. 7 and 8.
Figure 10:
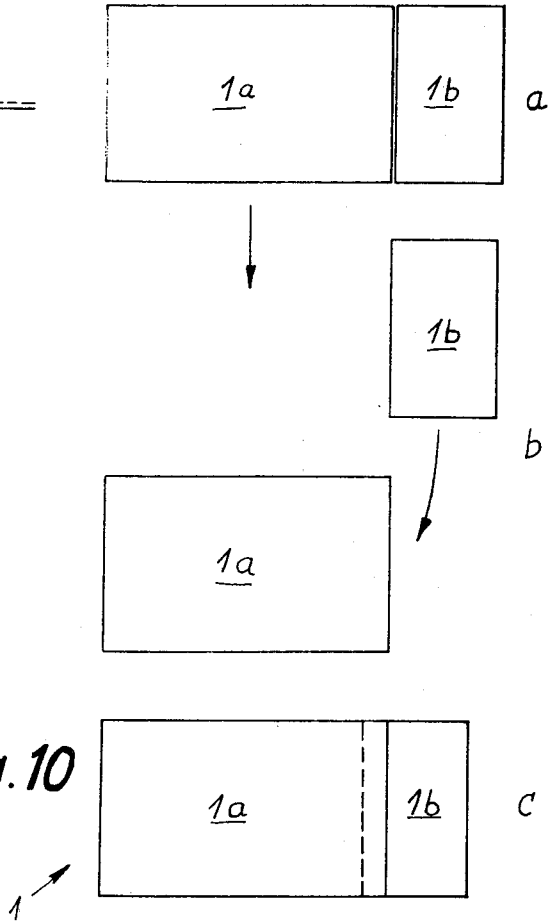
FIG. 10 illustrates three different relative positions of blank sections during transport with the conveyor of FIGS. 7 and 8.

FIG. 9 is a diagram wherein the time *t* is measured along the abscissa and the distance *s* along the ordinate. The solid-line curve indicates the movements of the drum 63, and the broken-line curve indicates the movements of the drum 64. Thus, the two curves respectively represent the movements of blank sections 1*a* and 1*b* with the blank forming conveyor 54. FIG. 10 illustrates three selected positions of a pair of associated blank sections 1*a*, 1*b* relative to each other during travel with the drums 63 and 64 of the conveyor 54.

The operation of the blank forming conveyor 54 of FIGS. 4*b*, 7 and 8 is as follows:

The knife 58 of the blank feeding unit 9 cooperates with the stationary counterknife 59 to intermittently sever the strips 42*a*, 42*b* which are formed by the disk-shaped knife 56 of FIG. 4*b*. In this way, the knife 58 subdivides the strips 42*a*, 42*b* into a succession of transversely aligned blank sections 1*a* and 1*b*. The sections 1*a* are attracted to the periphery of the cylindrical body 426 by suction ports 429, and the sections 1*b* are attracted to successive segment-shaped holders 438 by suction ports 447 in the respective facets 446 so that the sections 1*a*, 1*b*are located side-by-side (see FIG. 10*a*). As shown in FIG. 8, each section 1*a* is attracted by the suction ports 429 in such a way that its right-hand edge portion extends beyond the respective axial end of the cylindrical body 426. Upon completed transfer of a pair of aligned sections 1*a* and 1*b* onto the drums 63 and 64, the drive shafts 427 and 436 respectively rotate the cylindrical body 426 and the holders 438 at identical speeds (for a short interval of time, see the portion *a* of FIG. 10), and thereupon at different speeds (see FIG. 9 and the portion *b* of FIG. 10) so that the section 1*a* advances beyond the section 1*b*, as considered in the circumferential direction of the conveyor 54. This can be achieved by temporarily arresting the drive shaft 436 while the drive shaft 427 continues to rotate in a clockwise direction, as viewed in FIG. 4*b*. After the elapse of a certain interval of time (while the drive shaft 436 is at a standstill), the sections 1*a* and 1*b* are staggered with respect to each other, as seen in the circumferential direction of the conveyor 54 and as shown in the central portion *b* of FIG. 10. In the next step, the drive shaft 427 is arrested while the drive shaft 436 begins to rotate so that the section 1*b* catches up and again registers with the section 1*a* (see the portion *c* of FIG. 10). During the interval of idleness of the shaft 427, the roller follower 441 for the holder 438 which supports the just discussed section 1*b* travels along a portion of the face on the shifting cam 442 which causes the holder 438 to move toward the cylindrical body 426 of the drum 63 whereby the left-hand edge portion of the section 1*b* (as viewed in FIG. 8) moves below or inwardly of the adjacent edge portion of the registering section 1*a* so that the partially overlapping sections 1*a* and 1*b* form a composite blank 1 of the type shown in FIG. 1 or in the portion *c* of FIG. 10. Such axial movement of the holder 438 is possible because the diameter of the drum 64 is slightly less than the diameter of the drum 63 and also because the holders 438 are provided with the aforementioned facets 446 which are located at their leading ends, as considered in the direction of rotation of the drum 64.

When the sections 1*a* and 1*b* are positioned in a manner as shown in FIGS. 1 and 10*c*, the drive shafts 427, 436 are brought to a halt (such stoppage of the shafts 427, 436 coincides with the intervals of idleness of the conveyors shown in FIGS. 4*a* and 4*b*). When the next interval of movement of conveyors in the packing machine begins, the drive shafts 427, 436 are rotated at the same speed whereby the foremost composite blank 1 is delivered to the transfer conveyor 62 of FIG. 4*b*. Once a blank 1 is transferred beyond the drums 63 and 64, the empty holder 438 of the drum 64 is caused to return to its starting position at a maximum distance from the cylindrical body 426 of the drum 63 so that it can receive the next section 1*b* (see the axial position of the upper holder 438 shown in FIG. 8).

The placing of sections 1*a*, 1*b* of each blank 1 into overlapping positions while the turret 8 of the packing machine is at a standstill is desirable because the moving parts of the blank feeding unit 9 must be driven at a relatively low speed. As mentioned before, the transport of blanks 1 in such a way that their longer sides move sideways is also desirable for the same purpose, i.e., to allow for transport of blanks 1 at a relatively low speed which is less conducive to misalignment of blanks during transport toward the transfer station 66.

The operation of the packing machine is as follows:

The magazine or hopper 21 of FIG. 4*b* forms part of or receives filter cigarettes 4*a* from a producing machine, e.g., a filter cigarette making machine of the type known as MAX and produced by Hauni-Werke, Hamburg-Bergedorf, Western Germany. The means for transporting filter cigarettes 4*a* from the producing machine to the hopper 21 may comprise one or more pneumatic conveyors or a conveyor for containers of the type known as chargers or trays which are caused to dump their contents into the hopper 21 and thereupon return to a tray filling station to be refilled with filter cigarettes.

The cigarettes 4*a* which are fed into the main storing chambers 22 of the hopper 21 descend in the ducts 23 to enter the block building and transferring station 24 where they automatically form arrays which are suited for the formation of groups or blocks 4. One such block is transferred from the ducts 23 whenever the drive shaft 27 causes the pusher 26 to perform a working stroke and to thus advance a block 4 into the registering empty cell 29 of the chain conveyor 28. The pusher 26 performs working strokes while the chain conveyor 28 is at a standstill. The conveyor 28 thereupon transports the blocks 4 in stepwise fashion toward the transfer station 39. The pusher 37 at the station 39 performs working strokes during the intervals of idleness of the chain conveyor 28 and turret 8 whereby the block 4 which registers with the pusher 37 leaves the respective cell 29 and enters the registering hollow mandrel 36.

The continuously driven advancing rolls 46 of the first blank feeding unit 9 draw the web 42 from the source or bobbin 43 and the web 42 is severed by the rotating disk-shaped knife 56 to yield two strips 42*a*, 42*b* of different width. The knife 58 cooperates with the stationary counterknife 59 to sever the strips 42*a*, 42*b* at regular intervals so as to form a succession of aligned foil blank sections 1*a*, 1*b*. The sections 1*a*, 1*b* are accepted by the drums 63, 64 of the blank forming conveyor 54 and are manipulated in a manner as described in connection with FIGS. 7 to 10 to form a succession of composite blanks 1. The blanks 1 reach the transfer conveyor 62 and are delivered to successive mandrels 36 of the turret 8 at the transfer station 66.

The advancing rolls 81 in the blank feeding unit 11 are driven at a constant rate to draw the sheet 82 from the source or bobbin 83 and to advance the sheet into the range of the severing device 84. The sheet 82 is severed by the blades 87 of the rotary severing drum 86 in cooperation with the rotary counterknife 88, but the thus formed blanks 2 adhere to each other during travel in the direction indicated by arrow 89. The separation of each preceding blank 2 from the next-following blank 2 takes place in the space between the separating rolls 91 and 92 due to the fact that the peripheral speed of rolls 92 slightly exceeds the peripheral speed of rolls 91. Successive blanks 2 (whose configuration is shown in FIG. 2) are taken over by the drum 93 for delivery to the conveyor 96 and thereupon to successive mandrels 36 at the transfer station 74.

The removing device 103 of the blank feeding unit 12 pivots back and forth about the axis of the shaft 102 to attract foremost prefabricated cardboard blanks 3 (whose configuration is shown in FIG. 3) and to transfer such blanks from the magazine 101 to the periphery of the conveyor 108. The suction ports in the surface 104 of the removing device 103 are connected with a suction generating device (by way of the pipe 106) while the surface abuts against the adjacent end of the magazine 101 and also during transfer of blanks 3 toward the periphery of the conveyor 108. The suction ports 109 in that portion of the conveyor 108 which moves past the removing device 103 are connected to a suction generating device and strip the blank 3 off the surface 104 whereby such blank advances past the detector 284 and toward the applicator 116. The rollers 112, 113 are driven continuously to transfer films of adhesive paste onto the top faces of protuberances 114 on the applicator 116, and the protuberances 114 transfer films of adhesive onto selected fields of successive blanks 3 on the conveyor 108. As mentioned hereinabove, the protuberances 114 apply films P of adhesive paste to the fields *c*, *q*, *r*, *l*, *m* and *n* of successive cardboard blanks 3 (see FIG. 3). The folding member 118 thereupon folds the fields *a* and *b* of successive blanks 3 over the respective fields *c* and *d* whereby the film of adhesive on the field *c* attracts the field *a* and the field *b* simply overlies the field *d* (see FIG. 3*a*). The folding member 118 is actuated while the conveyor 108 is at a standstill. The partially deformed blanks 3 are transported seriatim and stepwise toward the transfer conveyor 122 which delivers them to successive mandrels 36 at the transfer station 126. The transfer conveyor 122 is provided with suction ports (not shown) which attract the partially deformed blanks 3 during transport from the conveyor 108 to the transfer station 126.

The formation of a pack 224 on the turrets 8 and 13 is carried out as follows:

The flaps 157, 158 associated with the mandrel 36 which reaches the transfer station 66 are caused to move apart in response to rotation of the respective cam 171 (see FIG. 4*c*) so that the composite blank 1 which has been delivered to such mandrel by the transfer conveyor 62 can be manipulated by the folding members 68 and 69. These folding members are actuated while the turret 8 is at a standstill and thereby provide the blank 1 with side panels 1*ax*, 1*bx* shown in FIG. 1*a*. The folding member 71 is actuated during the same interval of idleness of the turret 8 as the folding members 68, 69 and serves to fold the section 1*a* in a manner as shown at 1*aa* in FIG. 1*a*. Thus, the blank 1 is converted into a substantially L-shaped body and is additionally provided with the side panels 1*ax*, 1*bx*.

The flaps 157, 158 return to their operative positions shortly before the turret 8 is set in motion to thereby engage and hold the blank 1 during transport toward the transfer station 39. The flaps 157, 158 engage the side panels 1*ax*, 1*bx* of the sections 1*a*, 1*b* on the respective mandrel 36.

The mandrel 36, with the partially deformed blank 1 thereon, thereupon reaches the transfer station 39 and receives a block 4 while the turret 8 is at a standstill, i.e., in response to a working stroke of the pusher 37. During such interval of idleness of the turret 8, the folding member 72 is caused to move back and forth in the directions indicated by double-headed arrow 73 to further deform the blank 1 in a manner as shown in FIG. 1*b*. It will be noted that the folding member 72 of FIG. 4*b* converts the substantially L-shaped body of FIG. 1 into a substantially U-shaped body which is shown in FIG. 1*b*.

The mandrel 36, with the U-shaped blank 1 thereon and with a block 4 therein, is thereupon advanced by two steps to reach the transfer station 74. The flaps 157, 158 are caused to open in response to rotation of the cam 171 at the transfer station 74 so that the folding members 77 and 78 are free to reach the blank 1 and to provide the latter with the side panels 1*a'* shown in FIG. 2*a*. This completes the conversion of blank 1 into a prismatic body which is open at one end and has outer side panels 1*a'* which overlap the inner side panels 1*ax*, 1*bx*.

The transfer conveyor 96 delivers to the mandrel 36 at the transfer station 74 a blank 2 after the folding members 77, 78 reassume their starting or idle positions. Such delivery of a blank 2 takes place during that interval of idleness of the turret 8 in the course of which the folding members 77 and 78 were actuated to provide the blank 1 with the side panels 1*a'*. The central panel 2*a* of the blank 2 then overlies the overlapping portions of the sections 1*a*, 1*b* on the mandrel 36 at the transfer station 74 (see FIG. 2*a*). During the same interval of idleness of the turret 8, the folding members 98 and 99 are actuated to fold the panels 2*b* and 2*c* of the blank 2 over the side panels 1*a'* (see FIG. 2*a*). The flaps 157, 158 reassume their operative positions before the turret 8 is again advanced by a step whereby the lateral panels 2*b*, 2*c* of the finished insert or collar 2' on the mandrel 36 are held against movement away from the respective side panels 1*a'* of the section 1*a*.

The turret 8 thereupon transports the mandrel 36 (with a deformed blank 1 and a collar 2' thereon and with a block 4 therein) to the transfer station 126. The arrangement is such that the mandrel 36 arrives at the transfer station 126 slightly ahead of the cardboard blank 3 (which is being delivered by the transfer conveyor 122). The holder 177 (see FIG. 4*d*) is pivoted away from the mandrel 36 at the transfer station 126 as soon as the turret 8 is brought to a standstill whereby the conveyor 122 is free to place the fields *b* and *e* into abutment with the mandrel 36 (and more particularly into abutment with the section 1*a* of the blank 1, see FIG. 3*b*). The holder 177 thereupon returns to its operative position to press the blank 3 against the section 1*a* of the mandrel 36. The turret 8 is advanced by a step to transport the mandrel 36 to the folding station 127 where the respective cam 171 (see FIG. 4*c*) causes the flaps 157, 158 to move apart and to provide room for actuation of folding members at the station 127. The folding members 128, 129 are actuated during the first stage of the interval of idleness of the turret 8 (while the mandrel 36 with the blanks 1, 3 and collar 2' thereon dwells at the station 127) and respectively fold the fields *f*, *h* and *g*, *i* of the blank 3 whereby the fields *f* and *g* overlie the adjacent side panels 1*a'* of the section 1*a* and the panels 2*b*, 2*c* of the collar 2'. The fields *h* and *i* are coplanar with the fields *f* and *g* and extend beyond the closed end of the blank 1. The folding member 131 and the non-illustrated folding member at the stations 127 are actuated during the next stage of the same interval of idleness of the turret 8 to fold the fields *h* and *i* of the blank 3 against the closed end of the blank 1. The folding member 132 is actuated during the third stage of the same interval of idleness of the turret 8 to fold the fields *k*, *l*, *m* and *n* of the blank 3 whereby the latter assumes the shape which is shown in FIG. 3*c*. The field *k* of the blank 3 then overlies the fields *h* and *i*. The flaps 157, 158 reassume their operative positions during the last stage of the same interval of idleness of the turret 8 to press the fields *f* and *g* of the blank 3 against the adjacent panels 2*b* and 2*c* of the collar 2'. During the next following interval of movement of the turret 8, the outer side of the field *k* travels along a stationary retaining member (not shown) so that it continues to abut against the outer sides of the fields *h* and *i*.

When the mandrel 36 reaches the folding station 138 and the turret 8 comes to a standstill, the folding member 139 is actuated to fold the fields *l*, *m* and *n* of the blank 3 so that the field *l* abuts against a portion of the central panel 2*a* of the collar 2' (see FIG. 3*d*). The film of adhesive on the field *l* of the blank 3 adheres to the adjacent portion of the central panel 2*a* of the collar 2'.

The turret 8 is thereupon advanced by a step to transport the mandrel 36 to the transfer station 146. The flaps 157, 158 are caused to open as soon as the turret 8 comes to a standstill and the folding members 147, 148 are actuated to respectively fold the fields *m* and *n* over the fields *f* and *g* of the blank 3. Since the fields *m* and *n* are coated with adhesive paste (such paste is shown in FIG. 3, as at P), they adhere to the outer sides of the adjacent fields *f* and *g* whereby the blank 3 assumes the shape which is shown in FIG. 3*e*.

The holder 177 (see FIG. 4*d*) is pivoted away from the mandrel 36 at the transfer station 146 before the pusher 151 performs a working stroke to thereby expel the block 4 from the mandrel 36 at the station 146. Since the block 4 is moved against the bottom portion of the section 1*a* forming part of the blank 1, the collar 2' and the blanks 1, 3 are stripped off the mandrel 36 and enter the registering receptacle 190 of the lid forming turret 13. It will be noted that, on leaving the turret 8, the components 1, 2', 3 and the articles 4*a* of the corresponding block 4 form a pack which is nearly finished save for one end of the inner envelope and the hinged lid.

The receptacle 190, with a freshly received partially completed pack therein, reaches the folding station 191 in response to completion of two successive stepwise movements of the turret 13. The folding members 192, 193 at the station 191 are actuated as soon as the turret 13 comes to a standstill to fold the tucks 1*ab* of the sections 1*a*, 1*b* in a manner as shown in FIG. 3*f*. The tucks 1*ab* then overlie the adjacent ends of filter tips in the block 4.

The turret 13 is again indexed by a step to transport the receptacle 190 to the folding station 196. The folding member 197 is actuated when the turret 13 comes to a standstill whereby the panel 1*g* of the section 1*b* is folded over the adjacent ends of filter tips in a manner as shown in FIG. 3*g*.

The turret 13 is indexed again to advance the receptacle 190 to the folding station 199. The folding member 201 is actuated as soon as the turret 13 comes to a standstill whereby the projections 202, 203 of the folding member 201 respectively fold the fields *o* and *p* of the blank 3 against the adjacent panels 2*b*, 2*c* of the collar 2' (see FIG. 3*h*).

In response to renewed indexing of the turret 13, the receptacle 190 reaches the folding station 206 and the folding member 207 is actuated as soon as the turret 13 comes to a standstill whereby the fields *a*, *b*, *c*, *d*, *q* and *r* of the blank 3 are folded in a manner as shown in FIG. 3*i*. This results in folding of the previously unfolded portion 1*h* of the section 1*a* over the adjacent ends of filter tips (by the field *b* of the blank 3). The fields *a*, *c*, *q* and *r* remain in the plane of the fields *b* and *d*.

The turret 13 is indexed again to advance the receptacle 190 to the folding station 209 where the folding member 211 is actuated as soon as the turret 13 comes to a standstill so that the fields *a*, *c*, *q* and *r* of the blank 3 are folded in a manner as shown in FIG. 3*k*. Thus, the field *a* of the blank 3 overlies a portion of the central panel 2*a* of the collar 2'.

The receptacle 190 reaches the folding station 213 in response to renewed indexing of the turret 13, and the folding member 214 is actuated as soon as the turret 13 comes to a standstill. The projections 216, 217 of the folding member 214 thereby fold the adhesive-coated fields *q* and *r* of the blank 3 against the fields *o* and *p* to thus complete the formation of a hinged lid, i.e., the blanks 1, 2 and 3 are converted into a pack 224 (see FIG. 3*l*) which contains a block 4 of twenty filter cigarettes 4*a*. The pusher 222 at the transfer station 221 is actuated as soon as the folding member 214 completes its return movement to starting position so that the freshly finished pack 224 is expelled from its receptacle 190 and enters the registering container 226 of the conditioning conveyor 14. The pusher 222 performs its operation during that interval of idleness of the turret 13 during which the folding member 214 has completed the making of a hinged lid.

The container 226 encloses the finished pack 224 from four sides and its walls are preheated due to transport through the heating zone 227 (in a manner described in connection with FIG. 5). The blower 228 insures that the walls of the container 226 are maintained at an optimum temperature when the container reaches the transfer station 221 whereby the adhesive on the fields of the outer envelope 3' on a finished pack 224 is caused to set before the pack reaches the labelling unit 16. It will be noted that the conditioning conveyor 14 is large enough (i.e., it comprises a substantial number of containers 226) to insure that each envelope 3' has ample time for setting of adhesive on its fields prior to expulsion of the pack 224 from the respective container 226.

The conditioning conveyor 14 constitutes an optional but highly desirable part of the improved packing machine. The provision of a conditioning conveyor is especially important when the material of blanks 3 is relatively stiff so that the fields of each blank 3 exhibit a strong tendency to return into a common plane (see FIG. 3). The temperature of air which circulates in the channel 232 of the blower 228 shown in FIG. 5 should be controlled with a view to insure satisfactory setting of adhesive on the fields of the outer envelopes 3' but also to prevent overheating of containers 226 which could result in charring of outer envelopes 3' and excessive drying of tobacco in the cigarettes 4*a*. Overheating of containers 226 should be prevented even if the conveyor 14 is held at a standstill for extended periods of time. To this end, the blower 228 can be provided with a thermostat which automatically opens the circuit of the electric resistance heater 233 when the temperature of air which circulates in the channel 232 rises to a predetermined value.

If the adhesive which is stored in the tank 111 of the blank feeding unit 12 is a thermoplastic adhesive which softens in response to heating, the blower 228 of FIG. 5 is replaced with a blower for cold air.

When a filled container 226 reaches the transfer station 239 and the conditioning conveyor 14 comes to a halt, the pusher 241 performs a working stroke and transfers the pack 224 into the registering socket 244 of the conveyor belt 243. The latter is driven in stepwise fashion to move successive packs 224 into the labelling unit 16. The ram 249 of the conveyor 248 in the labelling unit 16 removes successive labels 247 from the magazine 246 and transports the exposed surfaces of such labels along the paster 251 so that the labels are coated with adhesive before they reach a finished pack 224 on the conveyor belt 243. The ram 249 applies adhesive-coated labels to the fields *c* and *l* of outer envelopes 3' on successive packs 224. Thus, the label 247 connects the fields *c* and *l* to thereby prevent pivoting of the hinged lid to its open position without tearing the label. The conveyor belt 243 is then advanced by a step to move the foremost pack 224 which carries a label 247 to the folding or draping station 252. The folding member 253 is actuated as soon as the conveyor belt 243 comes to a halt whereby a portion of the label 247 is folded over and adheres to the field *d* of the outer envelope 3'.

Successive packs 224 which are provided with revenue labels 247 are thereupon removed from the respective sockets 244 of the conveyor belt 243 and are transported to a further processing station, for example, to a carton filling machine or to a further packing machine which provides each pack 224 with a transparent outer envelope consisting of cellophane or the like and preferably embodying a suitable tear strip.

When a purchaser opens a pack 224 by pivoting the hinged lid to open position, the revenue label 247 is destroyed so that it cannot be reapplied to a fresh pack. In order to gain access to the filter tipped ends of cigarettes 4*a*, the purchaser withdraws the section 1*b* (the socalled flap) of the inner envelope. The section 1*b* is discarded so that a further cigarette can be removed from the pack as soon as or whenever the lid is pivoted to its open position.

Referring now to FIGS. 4*a*, 4*b* and 6*a*, 6*b*, when the detector 281 produces a signal to indicate that the block 4 in the adjacent cell 29 of the chain conveyor 28 is defective (e.g., that one or more cigarettes 4*a* are missing, that the heads of one or more cigarettes are unsatisfactory and/or that one or more filter tips are missing) or that the adjacent cell 29 is empty, the drive shaft 45 for one of the advancing rolls 44 in the blank feeding unit 9 of FIG. 4*b* is arrested during that same interval of idleness of conveyors when the detector 281 produces a signal. This is achieved by disengaging the electromagnetic clutch 351 of the control circuit branch 304 shown in FIG. 6*a*. Consequently, the knife 58 of the blank feeding unit 9 cannot sever the strips 42*a*, 42*b* of the web 42 and does not produce a pair of aligned blank sections 1*a*, 1*b*. The signal from the detector 281 further results in disengagement of the electromagnetic clutch 352 of the control circuit branch 304 so that the advancing rolls 81 in the blank feeding unit 11 are arrested and cease to transport the cardboard sheet 82.

Still further, the signal from the detector 281 causes the valve 353 in the control circuit branch 304 to close and to thus disconnect the suction ports in the surface 104 of the blank removing member 103 (blank feeding unit 12) from the associated suction generating device so that the conveyor 108 does not receive a blank 3.

As the signal from the detector 281 is being transmitted to the corresponding input of the AND-gate 317 in the control circuit branch 301 of FIG. 6*a* while the other input of the gate 317 receives a signal from the pulse shaper 316, the output of the AND-gate 317 transmits a signal to the setting input *a* of the flip-flop 322 whereby the output *c* of the flip-flop 322 transmits a signal which is amplified at 323 and energizes the winding of the electromagnetic clutch 324. This clutch connects the shaft 34 of FIG. 4*b* to the associated drive means so that the plunger 33 performs a working stroke and thereupon a return stroke to expel the defective block 4 from the adjacent cell 29 (the plunger 33 preferably performs such strokes even if the adjacent cell 29 is empty, just to make sure that the cell will be completely evacuated before the chain conveyor 28 is again advanced by a step). The two inputs of the AND-gate 317 in the control circuit branch 301 of FIG. 6*a* receive signals from the detector 281 and pulse shaper 316 after the chain conveyor 28 has been advanced by a step beyond the detector 281 so that the plunger 33 performs a working stroke while it registers with the cell 29 containing the detected defective block 4 (or being empty).

The signal which is furnished by the detector 281 disappears as soon as this detector detects that the cell 29 which registers therewith contains a satisfactory block 4. Consequently, the feeding units 9, 11 and 12 begin a supply blanks 1, 2 and 3 and the making of packs 224 proceeds in the aforedescribed manner. It will be noted that the detector 281 not only insures the ejection of defective blocks 4 (which can be collected in a suitable receptacle, not shown, located behind the chain conveyor 28, as viewed in FIG. 4*b*) but that the detector 281 also insures that the turret 8 does not receive blanks 1, 2 and 3 which would be converted into a pack for the defective or absent block 4.

If the detector 281 produces several (e.g., three) successive signals or continues to produce a signal in response to several successive stepwise advances of the chain conveyor 28, the counter 321 in the control circuit branch 301 of FIG. 6*a* counts the signals and its output *c* furnishes a signal to the setting input *a* of the flip-flop 342 (by way of the OR-gate 341) in the control circuit branch 303. The output *c* of the flip-flop 342 furnishes a signal which is amplified at 343 and initiates the disengagement of clutch 344 so that the latter disengages the shaft 27 of the pusher 26 from its drive means. Thus, the pusher 26 ceases to introduce blocks 4 into the cells 29 of the chain conveyor 28.

The OR-gate 341 further transmits a signal to the input *a* of the flip-flop 346 whose output *c* then transmits signals to the amplifiers 347, 348, 349. Such signals do not influence the clutches 351, 352 and the valve 353 because the amplifiers 347 – 349 receive signals from the output *c* of the flip-flop 322 whenever the detector 281 detects a defective block 4 or the absence of a block. The same applies for the clutch 324 in the control circuit branch 301.

The output *c* of the counter 321 further transmits a signal to the setting input *a* of the flip-flop 326 in the control circuit branch 302. The output *c* of the flip-flop 326 transmits a signal to the corresponding input of the AND-gate 328 so that, when the other input of the AND-gate 328 receives a signal from the pulse shaper 316 interval of idleness of the conveyors in the packing machine), the output of the gate 328 transmits a signal to the counter 329. The latter is set in such a way that it automatically disconnects the conveyors of the packing machine from the main prime mover (see the clutch 332 in the control circuit branch 302) after the conveyors complete a predetermined number of steps so as to advance the last satisfactory filled pack 224 into the adjacent container 226 of the conditioning conveyor 14.

Since the presence of two or more successive defective blocks 4 (or the detection of two or more successive empty cells 29) normally indicates that the hopper 21 at the station 24 is empty or that one or more ducts 23 of the hopper 21 are clogged, it is desirable to automatically interrupt the feed of further blanks 1, 2 and 3 until after the cause of defective blocks 4 (or of the absence of blocks) in the cells 29 is detected and eliminated. It will be seen that, while the satisfactory blocks 4 (located downstream of the detector 281) continue to be treated in the customary manner to be enclosed in packs 224, the blank feeding units 9, 11 and 12 are deactivated as soon as the output *c* of the counter 321 furnishes a signal and before the counter 329 disengages the clutch 332. This insures that the turret 8 does not receive any blanks 1, 2 and/or 3 while the mandrels 36 do not receive blocks 4 from the chain conveyor 28 and while the remaining satisfactory blocks 4 in the mandrels 36 and receptacles 190 are being processed in the customary way. The connection between the counter 321 and the clutch 344 of the control circuit branch 303 insures that the cigarettes 4*a* are not wasted by being introduced into cells 29 (by pusher 26) and thereupon expelled from such cells (plunger 33) before they can reach the transfer station 39. The counter 329 can be set to disconnect the main prime mover (clutch 332) from the conveyors in the packing machine after the conveyors have completed twenty stepwise movements subsequent to generation of, for example, two or three successive signals by the detector 281.

If the detector 282 produces a signal to indicate the absence of a blank 1 (or the absence of the section 1*a* or 1*b* of such blank), the control circuits of FIGS. 6*a* and 6*b* automatically determines whether the absence of a blank 1 is attributable to generation of a signal by the twin detector 281. If the detector 281 did transmit a signal, there is no signal at the output of the NO-gate 319 and, therefore, no signal at the rightmost inputs of the AND-gates 337, 338 and 339. Consequently, the output of the AND-gate 337 cannot furnish a signal to the OR-gate 341 even if its central input does not receive a signal from the NO-gate 333, i.e., even if the input of the gate 333 receives a signal from the detector 282. This constitutes an automatic determination that the generation of a signal by the detector 282 is attributable to a preceding signal generation by the detector 281.

If the NO-gate 333 furnishes a signal to the AND-gate 337 (i.e., if the detector 281 did not produce a signal) the signal which is furnished by the detector 282 causes the gate 337 to transmit a signal to the input *a* of the flip-flop 342 and to the input *a* of the flip-flop 346 (by way of the OR-gate 341) so that the clutch 344 prevents an actuation of the pusher 26, the clutch 351 interrupts the feed of blanks 1, the clutch 352 interrupts the feed of blanks 2, and the valve 353 interrupts the feed of blanks 3.

The detector 281 produces a signal in response to generation of a signal by the detector 282 (because the signal from the output *c* of the flip-flop 342 results in disengagement of the clutch 344 for the shaft 27 of the pusher 26) so that the input *a* of the counter 321 receives a signal. If the counter 321 receives a predetermined number of signals, its output *c* transmits a signal to the input *a* of the flip-flop 326 so that the output *c* of the flip-flop 326 begins to transmit a signal to the corresponding input of the AND-gate 328. The other input of the AND-gate 328 receives successive signals from the pulse shaper 316 and, when the counter 329 receives a predetermined number of signals from the output of the AND-gate 328, it causes the flip-flop 327 to disengage the clutch 332 so that the conveyors of the packing machine are arrested upon completed transfer of all satisfactory blocks 4 (and the packs which are formed therearound) into the containers 226 of the conditioning conveyor 14. Of course, the counter 321 will transmit a signal only if its input *a* receives a predetermined number of signals. This insures that the conveyors are not arrested in response to detection of the absence of a single blank 1 (detector 282).

If the distances which the blanks 1, 2 and 3 cover on their way to the mandrels 36 at the transfer stations 66, 74 and 126 are not properly related so that each block 4 which is located ahead of a missing block or ahead of a defective block (detector 281) is not confined in a satisfactory hinged-lid pack, the absence of one or more components (block 4, blank 1, blank 2 and/or blank 3) is detected by the four-way detector 286 which transmits a signal to the input *a* of the shift register 363 (by way of the AND-gate 362) whereby the signal travels through the shift register 363 in response to signals which are furnished to the inputs *b* of the shift register by the pulse shaper 313 (it will be noted that the shift register 363 constitutes a time-delay device). The output *c* of the shift register 363 transmits a signal to the amplifier 364 which energizes the winding of the clutch 366 in the control circuit branch 307 of FIG. 6*b* whereby the clutch 366 connects the shaft 236 to the corresponding drive means so that the plunger 234 performs a working stroke and expels the defective pack (namely, the pack having defective and/or missing components detected by the four-way detector 286) from the adjacent container 226 of the conditioning conveyor 14. The defective pack which has been expelled by the plunger 234 descends into a suitable intercepting receptacle or onto a suitable take-off conveyor, not shown.

The shift register 363 constitutes but one of several types of time-delay devices which can be used in the control circuit branch 307 of FIG. 6*b*.

If the detector 283 produces a signal in response to detection of the absence of a blank 2 between the severing device 84 and the separating rolls 91 in the blank feeding unit 11, the control circuit of FIGS. 6*a* and 6*b* again determines whether the absence of a blank 2 is attributable to the fact that the detector 281 has produced a single signal which resulted in interruption of the transmission of torque to the shaft 80 (the signal from the detector 283 is then suppressed) or whether the absence of a blank 2 is attributable to another cause, such as improper operation of the blank feeding unit 11. In the latter instance, the signal which is produced by the detector 283 is transmitted to the input *a* of the flip-flop 342 in the control circuit branch 303 whereby the output *c* of the flip-flop 342 furnishes a signal which initiates the disengagement of clutch 344 for the pusher 26. The signal from the detector 283 further initiates (by way of the flip-flop 346) the disengagement of clutch 351 for the shaft 45 of the advancing rolls 46, the disengagement of the clutch 352 for the shaft 80 and the closing of valve 353 in the suction pipe 106 so that the absence of blanks 2 entails an interruption of the delivery or blanks 1 and also of the delivery of blanks 3.

The packing machine continues to process satisfactory blocks 4 which are located ahead of the foremost empty cell 29 and the conveyors are arrested by the counter 329 when the last complete pack 224 enters a container 226 of the conditioning conveyor 14.

It will be noted that the processing of signals which are generated by the detector 282 is clearly analogous to that of signals which are produced by the detector 282.

If the detector 284 detects the absence of a cardboard blank 3 on the conveyor 108 of the blank feeding unit 12, the control circuit of FIGS. 6*a* and 6*b* automatically determines whether or not the generation of a signal by the detector 284 is attributable to generation of a single signal by the detector 281. In such an event, the signal which is furnished by the detector 284 is suppressed. Otherwise, the signal from the detector 284 is transmitted to the input *a* of the flip-flop 342 by way of the gates 336, 339 and 341 whereby the output *c* of the flip-flop 342 produces a signal which is used to disengage the clutch 344 for the shaft 27 of the pusher 26. The signal from the detector 284 also causes the flip-flop 346 to disengage the clutches 351, 352 and to close the valve 353. If the detector 284 detects the absence of a predetermined number of blanks 3, the detector 281 causes the counter 321 to furnish a signal which causes the counter 329 to automatically stop the conveyors as soon as the last satisfactory pack 224 enters a container 226 of the conditioning conveyor 14.

The signal from the detector 284 is further transmitted to the input of the flip-flop 354 whose output *c* transmits a signal to the AND-gate 357 of the control circuit branch 306. The output signal from the AND-gate 357 is transmitted to the amplifier 359 by way of the counter 358 and flip-flop 356 whereby the valve 361 opens and connects the nozzle 94 in the pipe 95 with the associated source of compressed fluid so that the nozzle 94 expels a certain number of blanks 2. This insures that the feeding unit 11 cannot deliver blanks 2 if the feeding unit 12 fails to deliver blanks 3. If the number of signals furnished by the detector 284 suffices to produce a signal at the output *c* of the timer 321, the timer 329 is actuated and automatically disengages the clutch 332 to arrest the conveyors when the last satisfactory pack 224 enters the corresponding container 226 of the conditioning conveyor 14.

The purpose of the counter 358 is to insure that, due to different distances which are covered by the blanks 1, 2, 3 on their way to the turret 8, the nozzle 94 expels the last finished blank 2 which would otherwise reach a mandrel 36 which does not carry a blank 2 and is not about to receive a blank 3.

If the detector 280 behind the labelling unit 16 detects a pack 224 which is not provided with a revenue label 247, the winding of the clutch 384 is energized by way of the gates 379, 381, flip-flop 382 and amplifier 383 in the control circuit branch 311 whereby the clutch 384 connects the shaft 257 to the corresponding drive means so that the plunger 256 performs a working stroke and expels the unlabelled pack 224 from the respective socket 244 of the conveyor belt 243. The expelled pack 224 (which is satisfactory save for the absence of a label 247) is introduced into the tower 261 in a manner not shown in FIG. 4*a* and is held in readiness for introduction into a socket 244 as a substitute for a packing missing in a container 226 of the conditioning conveyor 14.

Signals for transfer of packs 224 from the tower 261 into empty sockets 244 of the conveyor belt 243 are generated by the detector 287 which is adjacent to the path of containers 226. The clutch 372 of the control circuit branch 308 is energized during the same interval of idleness of the conveyors 14 and 243 (by way of the gates 367, 368, flip-flop 369 and amplifier 371) whereby the clutch 372 connects the shaft 263 to the associated drive means so that the pusher 262 performs a working stroke and transfers the lowermost pack 224 from the tower 261 into the registering empty socket 244 of the conveyor belt 243. This compensates for the absence of a pack 224 in a container 226 of the conditioning conveyor 14. In other words, each and every socket 244 normally carries a satisfactory pack 244 toward the conveyor of the labelling unit 16.

The detector 288 produces a signal in response to detection of an empty socket 244. This can happen when the tower 261 is empty and at least one of the containers 226 located between the transfer stations 221 and 239 is also empty. The signal from the detector 288 results in disengagement of the clutch 378 in the control circuit branch 309 of FIG. 6*b* (by way of the gates 373, 374, flip-flop 376 and amplifier 377) whereby the clutch 378 disconnects the conveyor 248 in the labelling unit 16 from the associated drive means. Thus, the conveyor 248 does not withdraw a label 247 to thereby insure that the labels are not wasted due to absence of packs 224 in the sockets 244 of the conveyor belt 243. The revenue labels 247 are expensive and must be accounted for to the tax authorities; therefore, the provision of detector 288 or an analogous detector is of importance to invariably insure that the conveyor 248 removes from the magazine 246 a label 247 only when it is certain that the removed label will be applied to a pack 224.

The provision of a relatively large number of detectors (281–289) in the control circuit of the packing machine is desirable because the components of hinged-lid packs are expensive so that the waste should be reduced to a minimum. This is achieved in the aforedescribed manner by automatically interrupting the delivery of other blanks and blocks 4 if the delivery of one blank is interrupted and/or by interrupting the delivery of all blanks if the delivery of blocks 4 is interrupted. In other words, no pack 224 is to be formed if one of its components is missing. In the absence of detectors 281 – 289, a pack which is formed on a mandrel 36 that does not contain a block 4 would have to be removed from the packing machine by hand so that at least one attendant would have to observe the transport of blocks 4 in order to detect empty cells 29 and/or empty mandrels 36 and to remove those inner and outer envelopes and inserts 2' which are formed on an empty mandrel. Moreover, the forming of empty packs around empty mandrels 36 and/or in receptacles 190 can cause serious problems because the final deforming steps upon the blanks 1 and 3 during the formation of hinged lids take place by folding portions of sections 1*a*, 1*b* against the adjacent ends of blocks 4 and by thereupon folding certain fields of blanks 3 over the thus folded portions of the blank sections 1*a* and 1*b*. In other words, the blocks 4 in the receptacles 190 constitute back supports for the respective sections 1*a* and 1*b* to insure proper folding of such sections in a manner as illustrated in FIGS. 3*h* and 3*i*. The problem is further aggravated if the packing machine is directly coupled with a producing (cigarette making or filter cigarette making) machine because each and every stoppage of the packing machine normally necessitates a stoppage of the producing machine with attendant losses in output.

As described above, the generation of a signal by the detector 281 automatically results in interruption of the feed of blanks 1, 2 and 3 to that mandrel 36 which should have received the block 4 whose absence or defectiveness has been detected by the detector 281. Analogously, the detection of the absence of a blank 1, 2 or 3 by the detector 282, 283 or 284 results in generation of a signal which causes the plunger 33 to expel the corresponding block 4 from the adjacent cell 29 so that the mandrel 36 which failed to receive a blank 1, 2 and/or 3 cannot receive a block of cigarettes.

The detectors 281, 282, 283, 284 are located at such distances from the respective transfer stations 39, 66, 74 and 126 that the detection of the absence of blanks 1, 2, 3 and/or the absence of blocks 4 (or defective blocks 4) entails an interruption of the transport of all blanks and an interruption of the transport of the blocks whereby the mandrel 36 which fails to receive a blank 1, 2 or 3 also fails to receive the other two blanks and a block 4. Analogously, a mandrel 36 which fails to receive a block 4 also fails to receive the blanks 1, 2 and 3. This greatly reduces waste in the valuable material of blanks and also reduces the number of rejected blocks 4 to a minimum.

An important advantage of the packing machine is that each of the blanks which are used to form the hinged-lid packs 224 for blocks 4 can be manipulated with a high degree of accuracy and that such accurate treatment does not interfere with the making of packs at a rate which is much higher than in presently known machines for the making of hinged-lid packs. Moreover, the steps of manipulating the blanks 1, 2 and 3 for each hinged-lid pack are selected in such a way that the folding, draping and/or other treatments of blanks do not affect the integrity and/or appearance of blocks 4.

The packing machine is susceptible of many additional modifications. Thus, even though FIGS. 4*a* and 4*b* show that each of the three discrete blank feeding units 9, 11 and 12 comprises means (conveyors 62, 96 and 122) for transporting the respective blanks 1, 2 and 3 to three different portions of the endless path for the mandrels 36 (see the transfer stations 66, 74 and 126), it is equally within the purview of the invention to assemble the blanks 2 with the blanks 1 and/or 3 prior to delivery to the assembly conveyor 8. For example, the feeding unit 11 can be designed to supply blanks 2 to the feeding unit 12 for the blanks 3. Each blank 2 is then attached to the corresponding blank 3 by means of one or more spots of adhesive. The thus obtained twin blanks are thereupon transported toward the path of mandrels 36 and are manipulated during transport with the assembly conveyor 8 and turret 13.

Each blank 1 may consist exclusively of metallic foil or exclusively of relatively soft and readily pliable paper.

It is further possible to replace the turret 8 with a chain conveyor which carries equidistant mandrels 36. However, an intermittently driven assembly conveyor in the form of a turret is preferred at this time because the mandrels 36 can be rigidly secured to its frame and also because the distances between the mandrels remain unchanged, even after long periods of use. The same holds true for the lid forming conveyor 13 and its receptacles 190. Accurate positioning of mandrels 36 and receptacles 190 when the respective conveyors are at a standstill is particularly important when the packing machine is directly coupled to a producing machine (such as a filter cigarette making machine or a machine for the production of plain cigarettes at a rate of up to and in excess of 70 cigarettes per second).

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A method of producing and manipulating blanks which are to be converted into inner envelopes of packs for cigarettes of other smokers' products, comprising the steps of withdrawing a single web of flexible wrapping material from a source and moving the web lengthwise in a predetermined direction; subdividing the web into composite rectangular blanks each of which consists of two discrete sections, including severing the web lengthwise to form only two discrete elongated strips and thereupon severing said discrete strips crosswise so that each strip yields a succession of discrete rectangular sections, each of said composite blanks consisting of a discrete section of one of said strips and a discrete section of the other of said strips and the area of each blank exceeding the area of either of said discrete sections thereof, the sections of each blank being movable in their entirety with respect to each other; moving one discrete section of each composite blank toward the other discrete section so that one section of each composite blank only partially overlaps the other section and said area of each blank is only slightly less than the combined area of the respective discrete sections; holding the web and said sections against flexing in a direction transverse to said web and to the direction of movement of said one section of each composite blank so that the length of each blank, as considered in the direction of movement of said one section, equals the combined maximum length of the respective sections minus the extent of overlap of such sections; and converting said composite blanks into inner envelopes to contain smokers' products.

2. A method as defined in claim 1, wherein the sections of each composite blank are aligned with each other, as considered at right angles to said direction of transport of said composite blanks to said transfer station.

3. A method as defined in claim 1, wherein said moving step takes place in the course of said transporting step.

4. A method as defined in claim 1, wherein at least one of said moving and transporting steps is carried out in a plurality of stages interrupted by intervals of idleness.

5. A method as defined in claim 1, wherein one section of each composite blank is larger than the other section.

6. A method as defined in claim 5, wherein said web consists of relatively thin and readily foldable material, such as metallic foil.

7. A method of producing and manipulating blanks which are to be converted into inner envelopes of packs for cigarettes or the like, comprising the steps of withdrawing a web of flexible wrapping material from a source and moving the web lengthwise in a predetermined direction; subdividing the web into composite rectangular blanks each of which consists of two discrete sections, including severing the web lengthwise to form two discrete elongated strips and severing said discrete strips crosswise so that each strip yields a succession of discrete rectangular sections, each of said composite blanks including a discrete section of one of said strips and a discrete section of the other of said strips and the area of each blank exceeding the area of either of said discrete sections thereof; and transporting said composite blanks in said direction to a transfer station, including moving one section of each composite blank toward said transfer station at a speed exceeding the speed of the other section of the respective composite blank so that the sections are staggered with respect to each other, as considered in the direction of transport toward said station, thereupon moving said other section at a speed exceeding the speed of said one section so as to move the sections into alignment with each other, and simultaneously moving one of said sections toward the other section so that one of said sections partially overlaps the other section before the respective composite blank reaches said transfer station.

8. Apparatus for producing and manipulating blanks which are to be converted into inner envelopes of packs for cigarettes or other smokers' products, comprising conveyor means for withdrawing a single web of flexible wrapping material from a source and for moving said web lengthwise in a predetermined direction along a predetermined path toward a transfer station; means for subdividing the web into a plurality of composite rectangular blanks each of which consists of two discrete sections, said subdividing means comprising means for cutting said web lengthwise so that the web yields only two discrete elongated strips and means for thereupon cutting said discrete strips crosswise so that each strip yields a succession of discrete rectangular sections, each of said composite blanks consisting of a discrete section of one of said strips and a discrete section of the other of said strips and the area of each blank exceeding the area of either of said discrete sections thereof, the sections of each composite blank being movable in their entirety with respect to each other and said conveyor means including means for transporting successive composite blanks in said direction toward said transfer station, said transporting means including means for reducing the distance between the sections of said composite blanks so that one section of each composite blank partially overlaps the other section of the respective composite blank and said conveyor means further comprising means for holding the web and said sections against flexing in a direction transversely of said path so that the overall length of each composite blank, as considered in said last named direction, equals the combined maximum length of the respective sections minus the extent of overlap of such sections; and means for converting said composite blanks into inner envelopes to contain smokers' products.

9. Apparatus as defined in claim 8, wherein said conveyor means further comprises at least one pair of web-withdrawing rollers.

10. Apparatus for producing and manipulating blanks for the making of packs for cigarettes or other smokers' products, particularly for producing and manipulating blanks which are to be converted into inner envelopes of cigarette packs, comprising conveyor means for withdrawing a single web of flexible wrapping material from a source and for moving said web lengthwise in a predetermined direction along a predetermined path toward a transfer station; means for subdividing said web into a plurality of composite rectangular blanks each of which consists of two sections movable in their entirety with respect to each other, said conveyor means including means for transporting successive composite blanks in said direction toward said transfer station and said means for transporting successive composite blanks comprising discrete first and second conveyors for the sections of said composite blanks and means for reducing the distance between the sections on said discrete conveyors so that one section of each composite blank partially overlaps the other section of the respective composite blank, said conveyor means further comprising means for holding the web and said sections against flexing in a direction transversely of said path so that the overall length of each blank, as considered in said last named direction, equals the combined maximum length of the respective sections minus the extent of overlap of such sections; and means for converting said composite blanks into inner envelopes to contain smokers' products.

11. Apparatus as defined in claim 10, wherein said conveyor means further comprises discrete first and second drive means for said first and second conveyors.

12. Apparatus for producing and manipulating blanks for the making of packs for cigarettes or the like, particularly for producing and manipulating blanks which are to be converted into inner envelopes of cigarette packs, comprising conveyor means for withdrawing a web of wrapping material from a source and for moving said web lengthwise in a predetermined direction along a predetermined path toward a transfer station; and means for subdividing said web into a plurality of composite rectangular blanks each of which consists of two sections, said conveyor means including means for transporting successive composite blanks in said direction toward said transfer station and said means for transporting successive composite blanks comprising discrete coaxial first and second rotary drums for the sections of said composite blanks and means for changing the distance between the sections on said discrete drums.

13. Apparatus as defined in claim 12, wherein the means for changing the distance between the sections comprises means for moving one of said drums axially toward and away from the other drum.

* * * * *